United States Patent [19]

Madison et al.

[11] Patent Number: 5,048,424

[45] Date of Patent: Sep. 17, 1991

[54] TIE REPLACER AND METHOD

[75] Inventors: Harry Madison, Germantown, Tenn.; G. Robert Newman, Fairmont, Minn.

[73] Assignee: Harsco Corporation, Wormleysburg, Pa.

[21] Appl. No.: 512,206

[22] Filed: Apr. 20, 1990

[51] Int. Cl.[5] ..... E01B 29/10

[52] U.S. Cl. ..... 104/9; 104/7.1

[58] Field of Search ..... 104/9, 6, 5, 2, 7.1, 104/12

[56] References Cited

U.S. PATENT DOCUMENTS

| | | | |
|---|---|---|---|
| 1,089,306 | 3/1914 | Bell | 104/6 |
| 3,521,769 | 7/1970 | Caperton | 104/6 |
| 3,698,324 | 10/1972 | Peppin et al. | 104/9 |
| 3,780,664 | 12/1973 | Holley | 104/9 |
| 3,877,384 | 4/1975 | Fearon et al. | 104/9 |
| 3,948,185 | 4/1976 | Settle et al. | 104/9 |
| 3,964,397 | 6/1976 | Dieringer | 104/9 |
| 4,127,070 | 11/1978 | Dieringer et al. | 104/9 |
| 4,392,433 | 7/1983 | Nyland | 104/9 |
| 4,643,100 | 2/1987 | Valditerra | 104/6 |
| 4,809,614 | 3/1989 | Theurer | 104/9 |
| 4,862,806 | 9/1989 | Theurer et al. | 104/9 |
| 4,955,301 | 9/1990 | Theurer et al. | 104/9 |

*Primary Examiner*—Robert J. Oberleitner
*Assistant Examiner*—Mark T. Le
*Attorney, Agent, or Firm*—Kerkam, Stowell, Kondracki & Clarke

[57] ABSTRACT

A vehicle for replacing selective ties in a road bed uses a conveyor system whereby ties may be picked up from on top of the rails. If the ties are to be used by the particular vehicle, they may be held by that vehicle. On the other hand, the conveyor system allows ties to pass over top of the vehicle such that the ties will be again disposed on top of the rails such that a following tie replacement vehicle may use the ties. By use of a tie replacement or inserter head having two tie clamps, one can more quickly remove an old tie from underneath the rails and replace the old tie with a new tie which has been picked up from on top of the vehicle. Electromagnets are used to hold the tie plates against the rails during the selective replacement of particular ties such that replacement of the tie plates is not usually necessary.

19 Claims, 20 Drawing Sheets

FIG. 17A
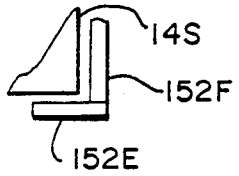
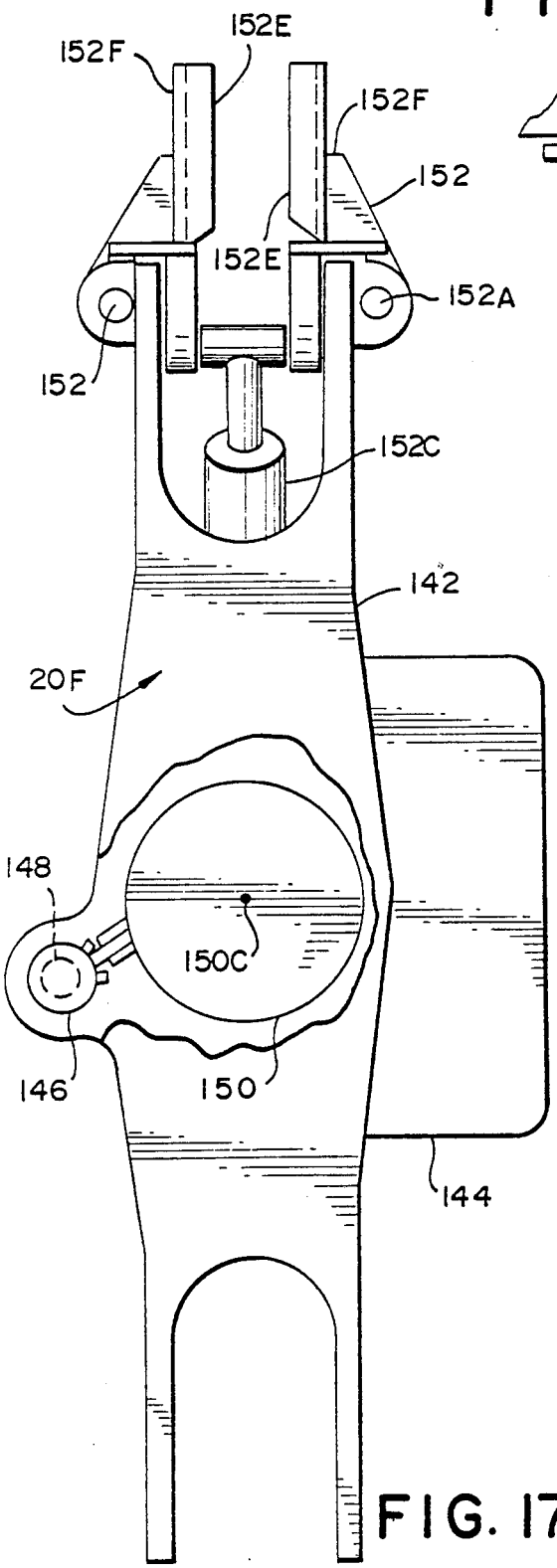
FIG. 17
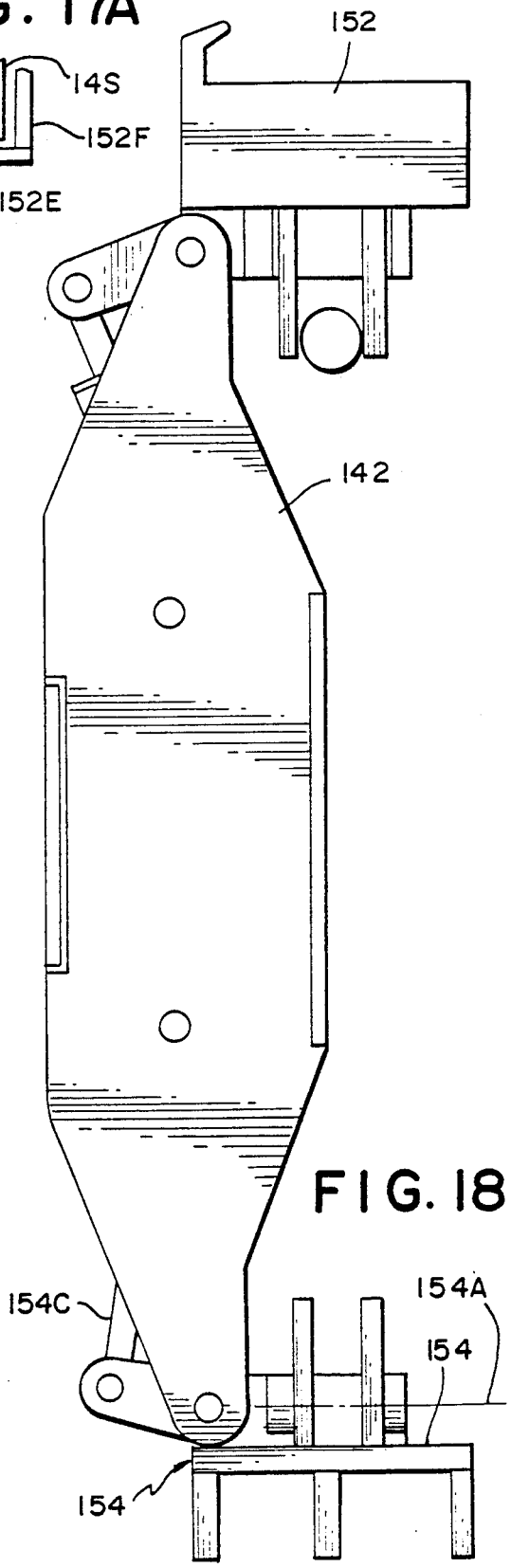
FIG. 18

FIG. 19A
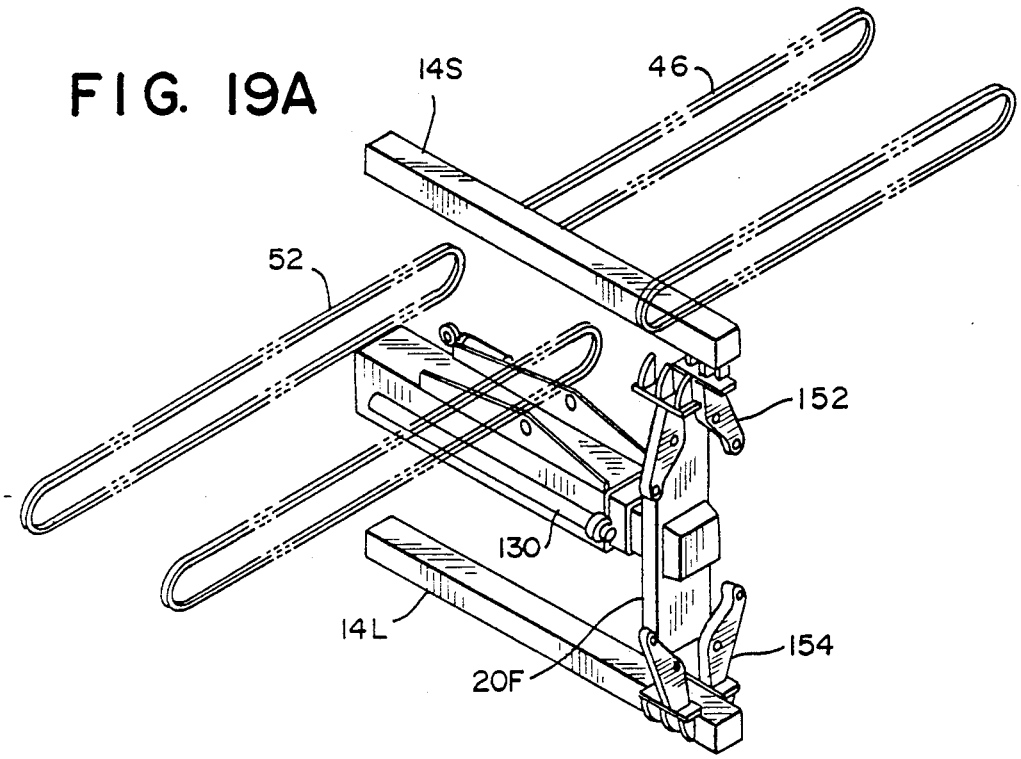
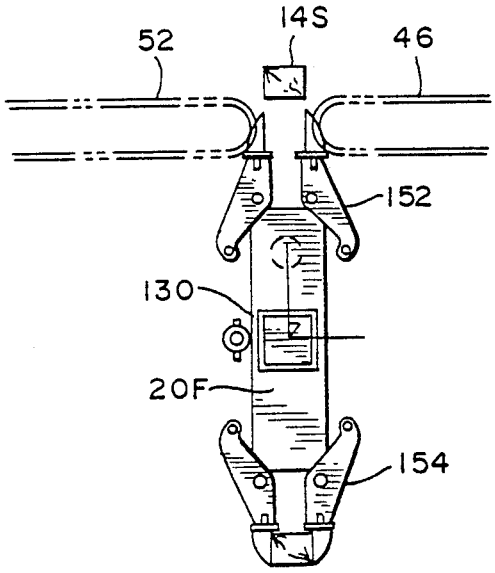
FIG. 19B
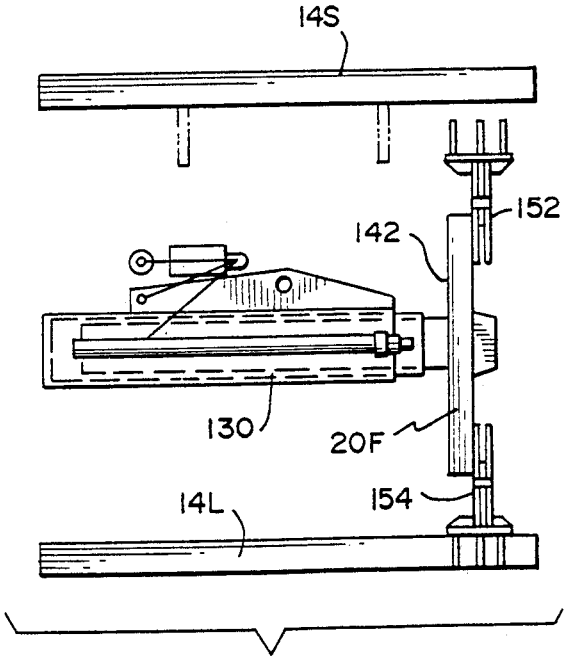
FIG. 19C

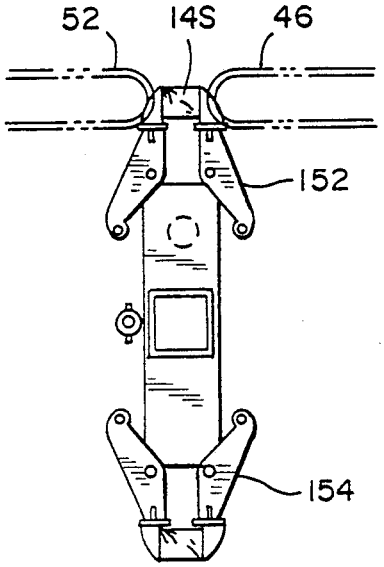
FIG. 20A
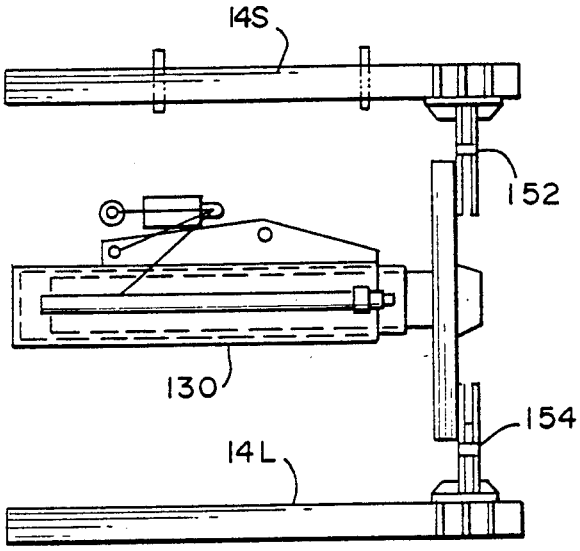
FIG. 20B
FIG. 22
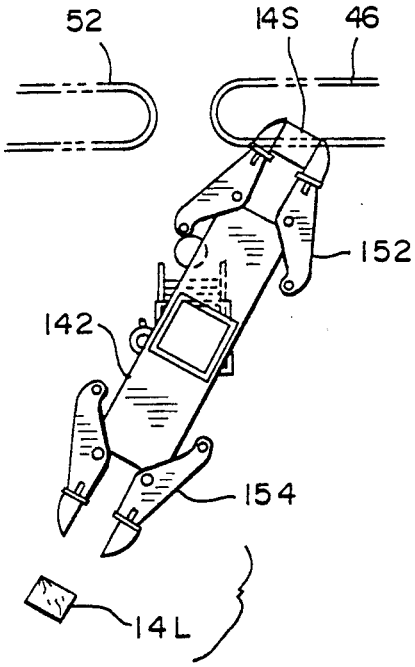
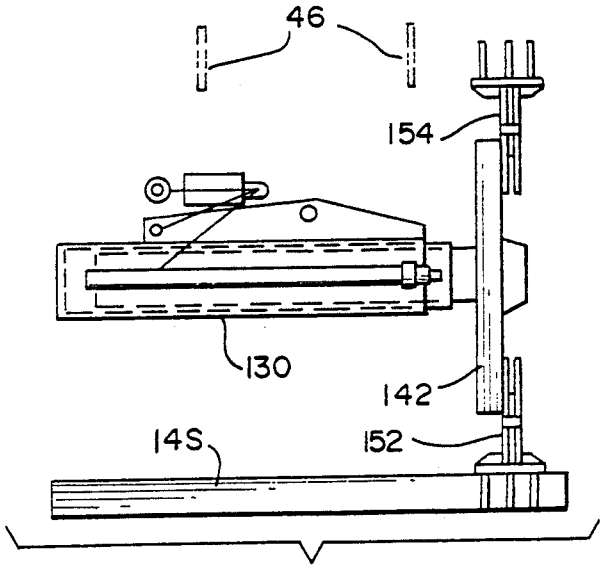
FIG. 23

TIE REPLACER AND METHOD

BACKGROUND OF THE INVENTION

This invention relates to a machine for inserting ties on a railroad track and a method of using such a machine. More specifically, this invention relates to a machine which also removes old ties from a railroad track road bed.

In order to maintain railroad tracks in safe operating conditions, it is necessary to replace the ties periodically. The ties (made of wood, metal or concrete) underneath the rails tend to wear out after an extended period of use.

Various machines for removing and/or inserting railroad ties into the railroad track road bed (hereafter "road bed") have been developed.

Among the prior machines for replacing ties are the machines disclosed by the following patents:

| U.S. Pat. No. | Inventor | Issue Date |
|---|---|---|
| 3,780,664 | Holley et al. | December 25, 1973 |
| 3,964,397 | Dieringer et al. | June 22, 1976 |
| 4,392,433 | Nyland | July 12, 1983 |
| 4,809,614 | Theurer et al. | March 7, 1989 |

The Holley et al patent shows a machine for inserting ties beneath a railroad track having a pantograph system to control the orientation of a tie clamp which is used for manipulating the tie. As common with many types of machines for removing ties, the arrangement includes rail clamps to secure the machine to the rail and a jacking system for supporting the machine on the ground while using the rail clamps to lift the rails to more easily remove or insert the tie disposed below the rail.

The Dieringer et al patent shows a tie handling machine having an inserter with a tie clamp and a boom for insertion of new ties. The new ties are laid upon the rails in advance of the machine.

The Nyland patent shows a backhoe type tie remover/inserter. An articulated arm at one end of the machine is used to manipulate ties. The other end of the machine has a loader bucket as commonly used on regular backhoes. The machine has tractor wheels for running on the road and a second set of wheels for rolling along a railroad track. Vertical "outrigger" jacks may be moved horizontally and used to support the vehicle as best shown at FIG. 6. Rail clamps may be used in combination with the vertical jacks in order to raise the rail for making it easier to insert or remove a tie from a particular portion of the track.

The Theurer et al patent shows a tie gang apparatus and system wherein a number of individual tie exchanging devices are operated substantially simultaneously at different track sections. The speed of the process is enhanced by the tandem arrangement of tie withdrawing and inserting devices.

Although prior tie inserter and/or remover machines have been generally useful, they have been subject to one or more of a number of disadvantages.

Some prior tie inserter vehicles insert new ties which have been previously deposited on the rails in advance of the vehicle. This is generally advantageous in that it is usually easier and quicker to pick up a tie laying upon the pair of rails then to pick up a tie which is deposited to the side of the road bed. However, depositing the ties upon the rail generally prevents one from using a tandem arrangement whereby different tie insertion vehicles operate upon different sections or zones of the road bed. In other words, a vehicle or device moving in front of the tie inserter can deposit the ties upon the rails, but this will allow only a front tie inserter vehicle to make use of the ties. Any second or following tie inserter vehicle will be separated from the source of the ties and the ties themselves by the front tie inserter vehicle.

Although one could in theory have a tandem arrangement of tie inserter vehicles wherein ties are placed upon the rails by a first source of ties (usually a flat car or cars having bundles of ties together with a crane or other arrangement for unloading the ties) in front of the first tie replacing vehicle and a second source of ties in between the first and second tie replacing vehicles, this increases the number of the machines needed for the tie gang operation and increases the cost and complexity of the operation.

One way to avoid the difficulty in providing tandem operation of tie insertion vehicles whereby two or more tie insertion vehicles operate simultaneously in different sections or zones of the road bed, is to place the ties to the side of the rail. In that fashion, the first tie inserter vehicle may move along the rail to its section, while bypassing the ties disposed at the side of the road bed, which ties may then be used by a second or following tie inserter vehicle. However, it is usually more difficult, time-consuming, and complex to provide an arrangement whereby a tie inserter vehicle picks up ties from the side of a road bed.

Another disadvantage of vehicles and mechanisms which are commonly used for tie insertion and tie removal is that they often require a first complex series of operations to remove an old tie followed by a second series of complex operations to insert a new or replacement tie.

A further disadvantage of numerous prior tie inserters is that an operator must perform relatively complex operations in order to clamp the new tie.

A further disadvantage of numerous prior tie inserter devices and systems will be more readily understood after a brief discussion of the procedures used for tie replacement. The tie replacement is accomplished by a tie gang which includes numerous machines which move along the rail. It should be noted that it is common to selectively replace only some of the ties. For example, one might replace only every third or fourth tie in a particular region. A spike pulling device or vehicle is used to pull spikes from the tie plates corresponding to ties which are to be replaced. A spike collecting device or vehicle could be used to collect the pulled spikes. A ballast clearing device is commonly used to make it easier to remove old ties within the road bed. A machine or vehicle lifts the rails at a portion of the track while pulling out an old tie disposed under that portion. The tie plates corresponding to the tie which is being replaced are usually replaced because the tie plates drop free of the rails upon lifting of the rails. After new ties and tie plates have been inserted, a machine is used for tamping ballast and a vehicle or device is used for spiking the replacement tie plates into the replacement ties. Of course, a vehicle or machine must be used to supply the replacement ties to the vehicle or machine which is inserting the replacement ties. Various other machines could be used as part of the overall process.

The complexity of the above process is substantially increased by the common requirement for removing old tie plates, which fall when the rail is lifted, and inserting and properly placing new tie plates. The increased complexity, cost, and time is disadvantageous in that the old tie plates are usually in quite acceptable condition. Indeed, often replacement tie plates are simply recycled old tie plates.

OBJECTS AND SUMMARY OF THE INVENTION

Accordingly, it is a primary object of the present invention to provide a new and improved tie inserter vehicle and method.

A more specific object of the present invention is to provide tie insertion whereby two or more tie inserter vehicles can work in tandem, while both (or all) tie inserter vehicles use ties which have been deposited upon the rail in advance of the leading tie inserter vehicle.

Yet another object of the present invention is to provide selective tie replacement (i.e., removal of old tie and insertion of replacement tie) by a mechanism which minimizes the time required by beginning to position the replacement tie, while simultaneously removing the old tie by a single cycle (or extension) of a boom.

A still further object of the present invention is to provide for more efficient tie replacement by avoiding the need to replace tie plates which are in acceptable condition.

Yet another object of the present invention is to provide for the insertion of ties wherein a replacement tie may be easily and quickly clamped by a tie inserter mechanism without requiring difficult (e.g., requiring great dexterity or hand - eye coordination) steps by a human operator.

A still further object of the present invention is to avoid or minimize the disadvantages noted above with respect to the prior tie inserter arrangements.

The above and other objects of the present invention which will become more apparent as the description proceeds are realized by a tie replacement vehicle including a main frame having a pair of front wheels and a pair of rear wheels. A first lifting conveyor has a lower end disposable at rail level corresponding to a pair of rails upon which the wheels are supported and an upper end at the main frame. The first lifting conveyor is mounted at the first end of the main frame and is operable to lift ties from a pair of rails to the main frame. A first lowering conveyor has a lower end disposable at rail level and an upper end at the main frame and is mounted at a second end of the vehicle opposite the first end. The first lowering conveyor is operable to lower ties from the main frame to placement on top of the pair of rails. Movement means selectively move ties over the vehicle from the upper end of the first lifting conveyor to the upper end of the first lowering conveyor. A tie inserter is supported by the main frame and includes a first tie clamp operable to clamp ties disposed on the vehicle at a location between the upper end of the first lifting conveyor and the upper end of the first lowering conveyor. The tie inserter is operable to insert a new tie under the pair of rails while the new tie is clamped by the first tie clamp. The tie inserter is operable to remove old ties from a road bed. The movement means includes a first top conveyor for receiving ties from the first lifting conveyor. Means are provided to move ties down from the first top conveyor to a position whereat the first tie clamp may clamp a tie. At least one stop is operable to stop ties at a portion of the first top conveyor while the first top conveyor continues to move such that ties back up at the portion. The vehicle further includes a transfer structure and a second top conveyor for receiving ties from the first top conveyor by way of the transfer structure, the second top conveyor operable to convey ties to the first lowering conveyor. The first top conveyor receives ties from the first lifting conveyor by way of a second lifting conveyor and the second top conveyor conveys ties to the first lowering conveyor by way of a second lowering conveyor. The tie inserter includes a boom extendable in a boom direction transversed to a lengthwise direction of the vehicle and a tie inserter head having the first tie clamp attached at a first end of an arm mounted to an end of the boom. The arm is rotatable about a substantially horizontal axis to lower a tie from the vehicle to a road bed. The axis extends substantially parallel to the boom direction. The tie inserter is operable to insert ties in the road bed by retraction of the boom.

The present invention may alternately be described as a tie replacement vehicle including a main frame having a pair of front wheels and a pair of rear wheels and support means on the main frame for supporting ties on the vehicle. A tie inserter on the vehicle is supported by the main frame and includes a boom extendable in a boom direction transfers to a lengthwise direction of the vehicle. The tie inserter further includes a tie inserter head having a first tie clamp attached at a first end of an arm mounted to an end of the boom. The first tie clamp is operable to clamp a tie disposed on the support means. The arm is rotatable about a substantially horizontal axis to lower a tie from the vehicle to a road bed. The axis extends substantially parallel to the boom direction. The tie inserter is operable to insert ties in the road bed by retraction of the boom. The arm has a second tie clamp at a second end thereof such that the second tie clamp is operable to clamp an old tie disposed in a road bed when the first tie clamp is clamping a replacement tie. The tie inserter is operable upon extension of the boom to remove the old tie from the road bed and to displace the replacement tie to outside of rails of the road bed. The first tie clamp maintains a replacement tie substantially horizontal upon rotation of the arm about the axis. The boom is mounted between the pair of front wheels and the pair of rear wheels. The support means is intermediate the upper end of the first lifting conveyor and the upper end of the first lowering conveyor.

The tie replacement vehicle may alternately be described as including a main frame having a pair of front wheels and a pair of rear wheels, support means on the main frame for supporting ties on the vehicle, and a tie inserter supported by the main frame. The tie inserter includes a boom extendable in a boom direction transverse to a lengthwise direction of the vehicle and a tie inserter head having a first tie attached at a first end of the arm mounted to an end of the boom. The tie inserter is operable to remove ties from a road bed and to lower ties from the vehicle and insert ties in the road bed by retraction of the boom. The vehicle further includes two pairs of electromagnets movably mounted to the main frame and operable to hold tie plates against corresponding rails during removal of a tie from the road bed and insertion of a tie into the road bed. The arm is rotatable about a substantially horizontal axis to lower a tie from the vehicle to a road bed.

The method of the present invention is a method for replacing ties in a road bed having rails and including the step of placing ties on top of the rails in advance of at least first and second tie replacement vehicles. The first tie replacement vehicle is then moved to a first zone of the road bed by way of a second zone of the road bed without using the first tie replacement vehicle to replace ties in the first zone. While moving the first tie replacement vehicle through the second zone, ties are conveyed from the top of the rails in front of the first tie replacement vehicle over the first tie replacement vehicle to the top of rails behind the first tie replacement vehicle by way of a conveyor system mounted to the first tie replacement vehicle. Ties are inserted into the road bed within the first zone by operation of the first tie replacement vehicle, and ties are inserted into the road bed within the second zone by operation of the second tie replacement vehicle using ties previously conveyed by the conveyor system of the first tie replacement vehicle. The method may further include the removal of old ties in the road bed within the first zone by operation of the first tie replacement vehicle and removal of old ties in the road bed within the second zone by operation of the second tie replacement vehicle. Each of the first and second tie replacement vehicles may be constructed according to the description given above. The conveyor system includes the first lifting conveyor and the first lowering conveyor.

As used herein, a "conveyor" shall refer to a conveyor belt, conveyor chain, or other closed loop arrangement.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 17 shows a side view of a tie inserter head according to the present invention, whereas FIG. 17A shows a top view of a small portion of the mechanism of FIG. 17;

FIG. 18 shows an end view of the tie inserter head of FIG. 17;

FIGS. 19A, 19B, and 19C respectively are a perspective view, a side view, and a back view of the boom and tie inserter mechanism in a particular position;

FIGS. 20A and 20B are respectively a side view and a back view of the boom and tie inserter mechanism in a particular position and state;

FIG. 22 is a side view of the tie inserter mechanism in a particular position;

FIG. 23 is a back view of the boom and tie inserter mechanism in a particular condition;

DETAILED DESCRIPTION

Figure 1:
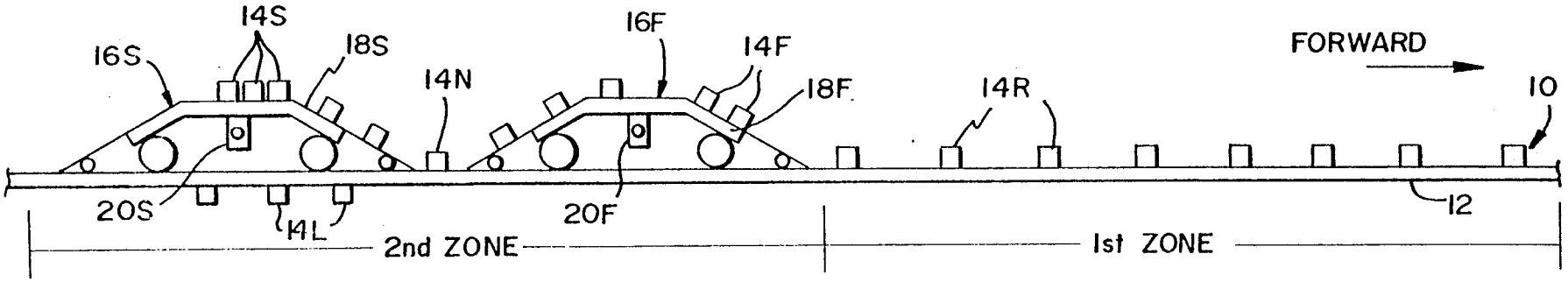
FIG. 1 is a schematic side view illustrating an important concept of the operation of the present invention.

With reference now to FIG. 1, the basics of the structure and operation of the tie inserter vehicle of the present invention will be explained. FIG. 1 shows a railroad track road bed 10 having a pair of rails 12 (only one of which is visible from the side view of FIG. 1) with a series of old ties 14L upon which the rails 12 are disposed. For ease of illustration, only a few of the old ties 14L are shown, but they are disposed all along the rails 12 and have ballast (not shown) in between them.

FIG. 1 also shows first and second tie inserter vehicles 16F and 16S which are used to replace selective ones of the old ties 14L with replacement or new ties 14R which have been placed upon the rails 12 in advance of the vehicle 16F and 16S. As indicated by the arrow and the word forward, the vehicles shown in FIG. 1 will be moving from left to right.

A significant feature of the present invention is that one may use the first vehicle 16F to selectively replace old ties within the first zone, while using the second vehicle 16S to selectively replace old ties 14L in the second zone of the road bed. Significantly, the second vehicle 16S may use ties which have passed over a conveyor system 18F from in front of the vehicle 16F to behind the vehicle 16F. Several ties such as 14F are shown passing over top of the vehicle 16F. The ties will pass completely over the vehicle 16F as it travels through the second zone. The ties which have passed over the vehicle 16F are deposited back upon the rail such as tie 14N. These ties will in turn be picked up by a conveyor system 18S mounted to the vehicle 16S. The ties travel up to the top of the vehicle 16S and may be held in place by an arrangement discussed in detail below. The ties back up as a group and are shown as 14S on top of the vehicle 16S. The ties 14S are then used by a tie inserter 20S (depicted schematically). In particular, the second vehicle 16S will remove selective ties 14L from the second zone and will replace those ties with ties 14S from the top of the vehicle 16S.

By having the conveyor system 18F mounted on top of the first vehicle 16F, the second vehicle 16S may use ties from the top of the rails 12, even though the first vehicle 16F must pass by the new or replacement ties before the second vehicle 16S reaches those ties. When the first vehicle 16F reaches the beginning of the first zone, a change may be made in the conveyor system 18F such that the ties will back up on top of vehicle 16F in similar fashion to the ties 14S disposed on second vehicle 16S. A tie inserter 20F of the vehicle 16F may then use those ties for replacing ties under the rails 12 within the first zone.

From the above, it will be appreciated that the vehicle allows for tandem operation whereby each of two tie replacement vehicles work in separate zones using ties previously disposed upon the top of the rails. The ties may be laid on top of the rails 12 using known techniques such as flat cars filled with ties (not shown) and a gantry crane (not shown) for moving the ties. The gantry crane or another machine may be used to place the ties upon the rails in front of both of the machines or vehicles 16F and 16S. There is no need to unload ties in between the vehicles 16F and 16S because of the manner in which the conveyor system 18F allows ties to pass over the vehicle 16F.

In the discussion above it was assumed that there would be two of the vehicles 16F and 16S. However, it will be readily appreciated that there could be three or a larger number of such vehicles in which case each of the vehicles would allow the ties to be conveyed over top of the tie replacement vehicles. For example, if one was using three such machines, there would be three zones and the first and second machine would pass through the third zone while leaving the ties behind for the third (back-most or trailing) machine to use. The first or lead tie replacement vehicle would pass through the second zone while conveying the ties over top of it such that the ties would be left behind for the second vehicle. The first vehicle would continue to the first zone whereupon it would begin storing the ties for use in replacing ties in the first zone. The second and third vehicles would respectively replace ties in the second and third zones. In that fashion, one can place the ties on top of the rail such that they may be more easily picked up for use by the vehicles, while at the same time providing for tandem operation of two or more tie replacement vehicles.

Figure 2:
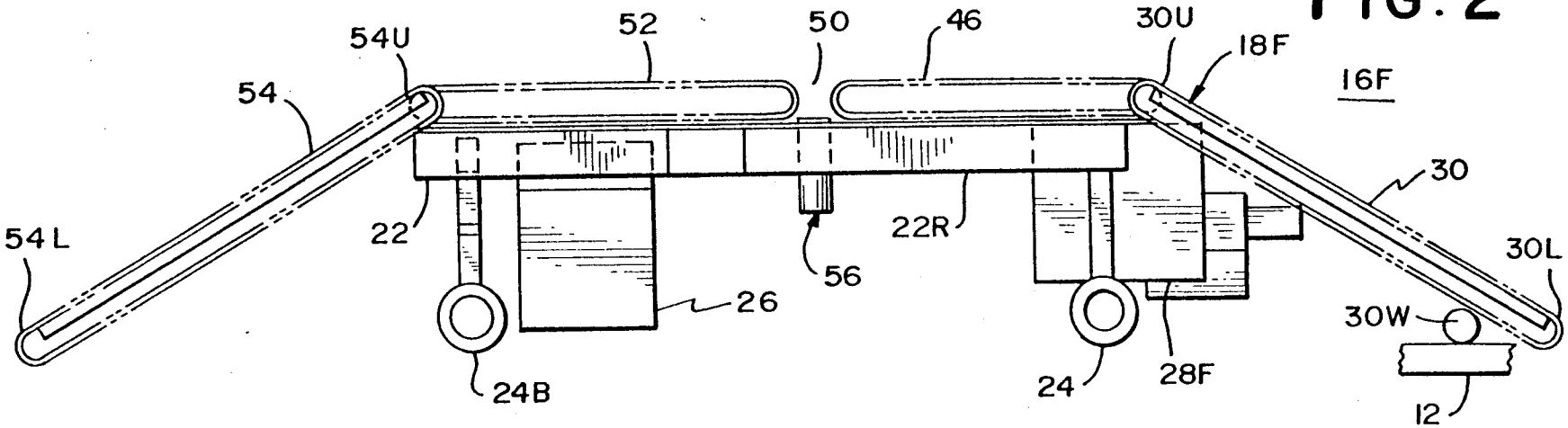
FIG. 2 shows a simplified side view of a tie replacement vehicle according to the present invention.

The structure of the first tie replacement vehicle 16F will be more readily understood from the simplified side view of FIG. 2. It will be appreciated that, although FIG. 2 shows vehicle 16F, vehicle 16S will be constructed in identical fashion.

The vehicle 16F includes a main frame 22 and front and back pairs of wheels 24F and 24B. A cab 26 is mounted to the frame 22 and allows a human operator (not shown) to ride within the vehicle 16F. The cab 26 may be constructed in various known fashions, but preferably would include dual controls (not shown) and would be open through the middle for common access to engine and brake controls. The dual controls would allow the human operator to operate the machine while riding in either the left or the right side of the cab. This will allow the vehicle 16F to be used for removing ties to the right of the rail or to the left of the rail depending upon the terrain around a particular section or zone of road bed.

An engine and pumps are shown generally at 28 and would operate in a known fashion to propel the vehicle 16F and to generate hydraulic fluid under pressure for use in operating various conveyors included within the conveyor system 18F and for operating various hydraulic circuits and controls constructed in known fashion.

Figure 4:
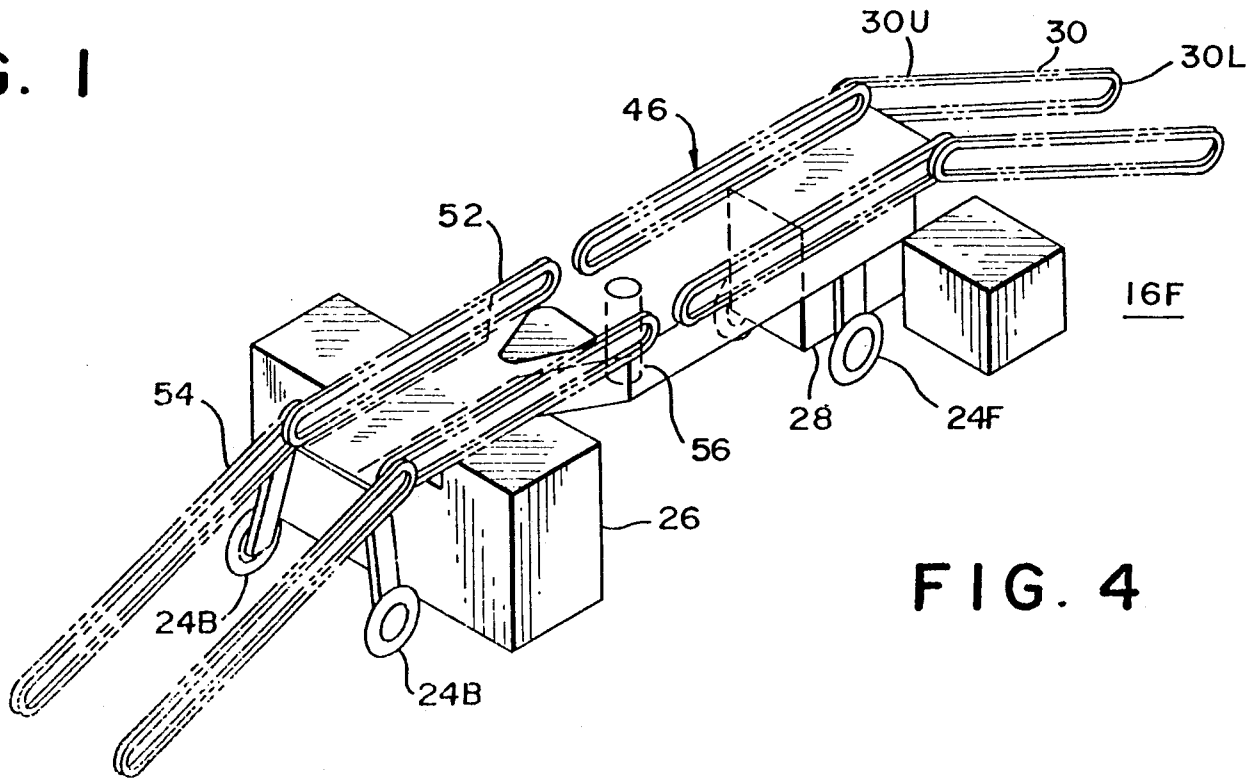
FIG. 4 shows a simplified perspective view of the tie replacement vehicle according to the present invention.
Figure 3:
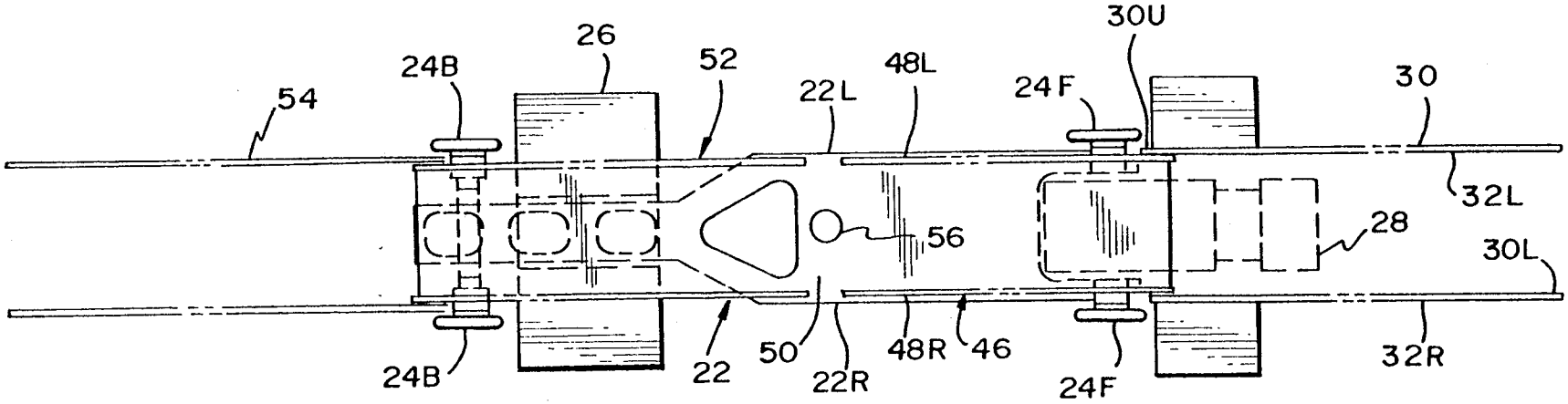
FIG. 3 shows a simplified top view of the tie replacement vehicle according to the present invention.

Continuing to view FIG. 2, but also considering the top view of FIG. 3 and the perspective view of FIG. 4, the conveyor system 18F includes a lifting or pick up conveyor 30 having a lower end 30L and an upper end 30U. The conveyor 30 includes right and left pairs of conveyor chains 32R and 32L respectively.

When the vehicle 16F is moving forward (left to right in FIGS. 2, 3, and 4), the lifting conveyor 30 will lift ties such as 14R from rails 12 (refer back to FIG. 1). Accordingly, the lower end 30L of conveyor 30 should be disposed between the rails 12. With reference especially to FIG. 2, one may optionally include a pair of wheels such as 30W (only one visible in the side view) which support the lower end 30L of conveyor 30 in the appropriate position.

Figure 5:
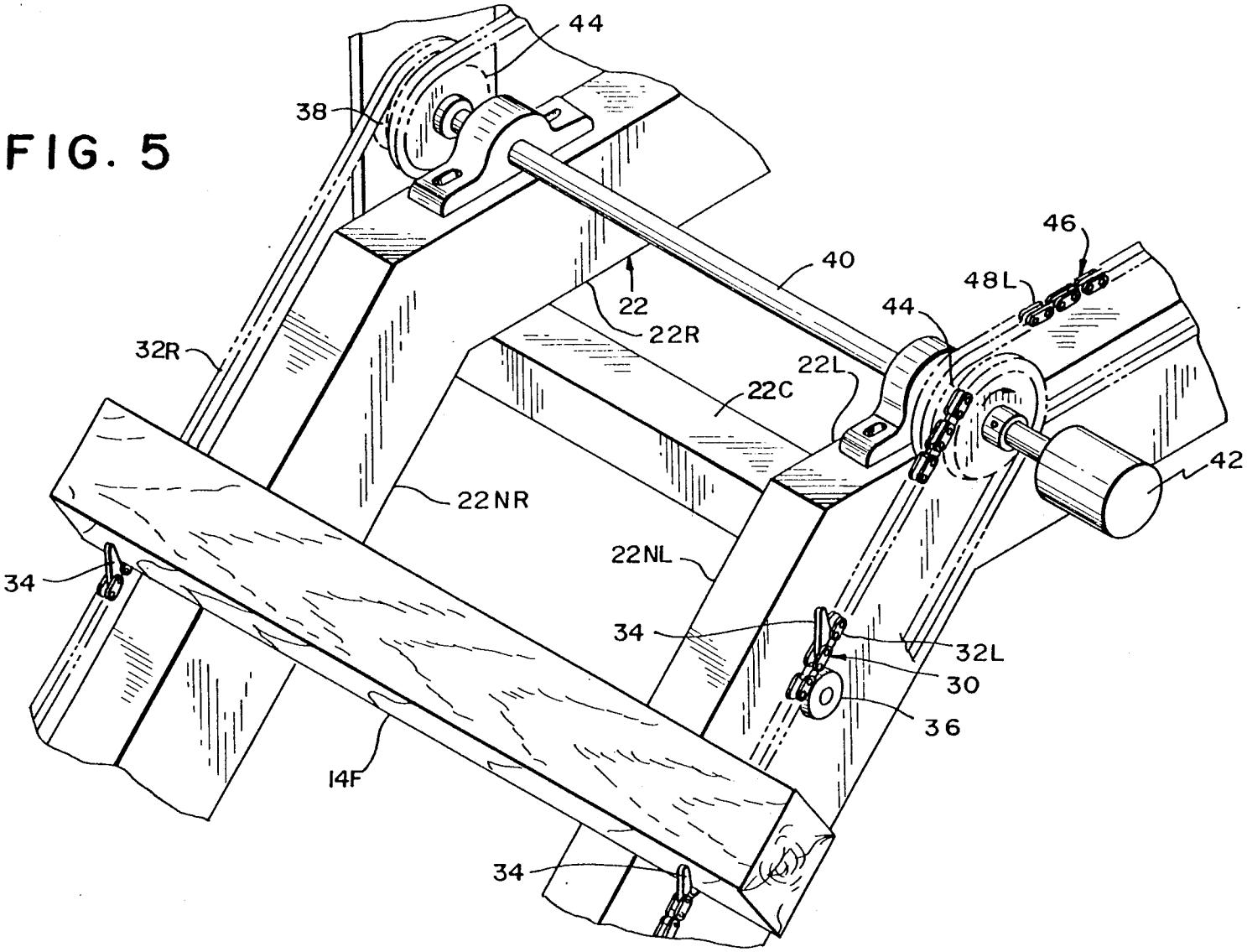
FIG. 5 shows a perspective view of a portion of the conveyer system of the present invention.

The manner in which the conveyor 30 may pick up ties such as 14R in FIG. 1 will be more readily understood with reference to FIG. 5. As shown in FIG. 5, the left side conveyor chain 32L (as FIG. 5 is from the reverse angle or opposite side from that shown in FIG. 2, the left chain 32L is on the right side of FIG. 5) includes a series of fingers 34 which may be used to grip the ties and pull them from the lower end 30L to the upper end 30U. Depending upon the angle of tilt or inclination of the conveyor 30, one could alternately use friction pads or other known arrangements such that, upon the lower end 30L of conveyor 30 being driven under a tie which has been placed across a pair of rails, the conveyor 30 will pick up the tie and carry it to the top of the vehicle 16F. A series of rollers 36 (only one shown in FIG. 5) may be used in order to support the conveyor chains 32L and 32R above inclined portions 22NR and 22NL which extend respectively from right and left portions 22R and 22L of the main frame 22. A series of cross members such as 22C (only one shown) may extend between the portions 22R and 22L and the corresponding inclined portions. The rollers 36 could be mounted to the portions 22NR and 22NL or alternately could be mounted to members (not shown) which are pivotably attached to extend in a lower inclined position like that of 22NR and 22NL in FIG. 5 and which may be pivoted into an upper position (not shown) wherein the lower end 30L of the conveyor 30 may be lifted to an upper position (not shown) away from the road bed.

As shown in FIG. 5, the conveyor chains 32L and 32R of lifting conveyor 30 are driven by sprockets 38 mounted at opposite sides of a lift conveyor shaft 40 which is journaled to the portions 22R and 22L of the main frame 22. As also shown, a hydraulic motor 42 is used to turn the shaft 40, thereby driving the sprockets 38 and an additional pair of sprockets 44 which drive a first top conveyor 46 having a right conveyor chain 48R and a left conveyor chain 48L (only the left conveyor chain 48L is visible from the partial view of FIG. 5). Referring back to FIGS. 2, 3, and 4, while continuing to consider FIG. 5, the top conveyor 46 has right and left chain conveyors 48R and 48L which proceed along the top of the vehicle 16F. The first top conveyor 46 will receive ties from the lift conveyor 30 (as will be appreciated from FIG. 5) and will carry the ties to a gap 50 (see especially FIG. 2) between the end of the first top conveyor 46 and the beginning of a second top conveyor 52. By closing the gap 50 by way of a transfer structure discussed in more detail below and not shown in FIGS. 2-5, ties may be passed over the gap 50 for passage along conveyor 52 and down a lowering conveyor 54 with having an upper end 54U and a lower end 54L. The construction of the second top conveyor 52 may be identical to the construction of first top conveyor 46, whereas the construction of lowering conveyor 54 may be identical to the lifting conveyor 30, it being understood that the lowering conveyor 54 carries ties from its upper end 54U to its lower end 54W. It will be appreciated that each of the four conveyors 30, 46, 52, and 54 shown in FIGS. 2, 3, and 4 would include right and left conveyor chains and operate on the basic principles mentioned in connection with FIG. 5. Although one might optionally use fingers such as 34 for the lifting conveyor 30, such fingers would not be used in connection with at least the first top conveyor 46. The second top conveyor 54 and the lowering conveyor 54 need not necessarily use such fingers.

Before discussing in detail how the ties can be passed over the gap 50, it should be noted that a pivot shaft 56 is fixed to the frame 22 and will be use for pivoting different portions of the machine described in more detail below about a central vertical axis in order to provide a "turntable" type feature whereby the present invention may be used to remove ties in a rightward direction from the road bed end, after operation of the turntable feature, in a leftward direction relative to the road bed.

Figure 7:
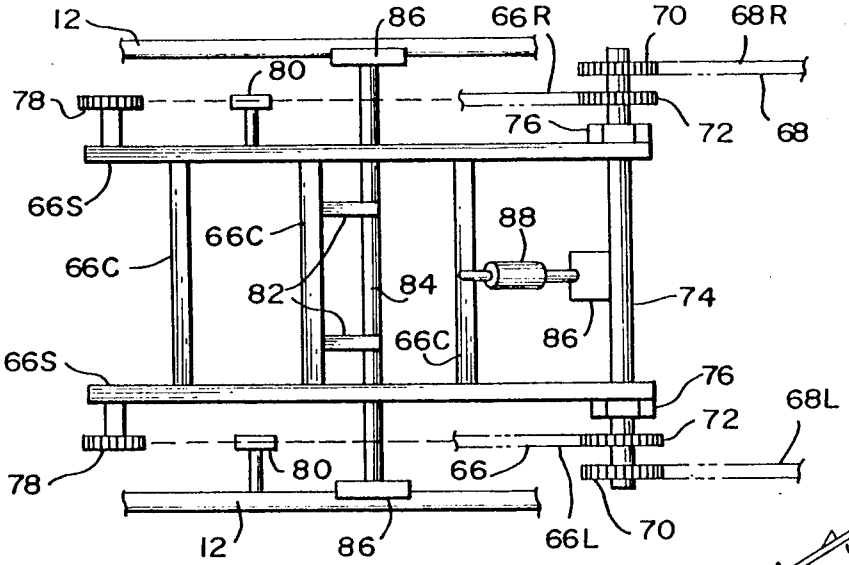
FIG. 7 shows a top view of a portion of the vehicle of FIG. 6.
Figure 6:
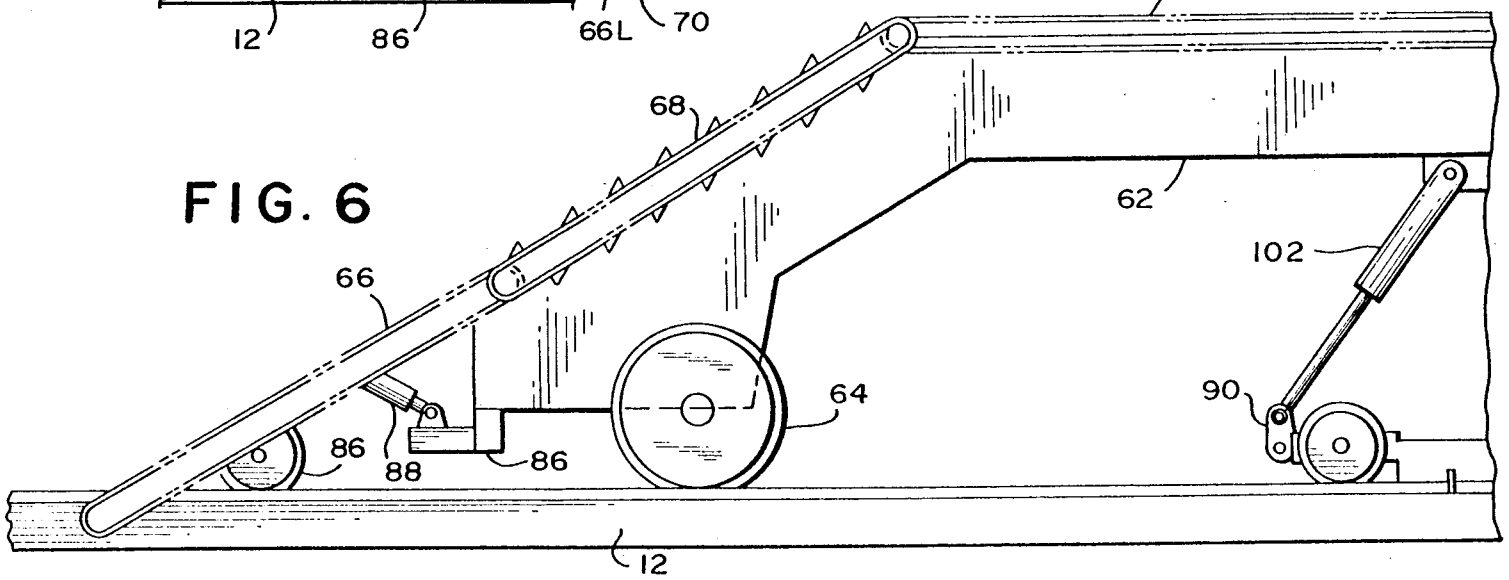
FIG. 6 shows a simplified side view of a portion of an alternate embodiment vehicle according to the present invention.

With reference now to FIGS. 6 and 7, an alternate construction for the lift conveyor 30 of FIGS. 2-5 and/or the lowering conveyor 54 of FIGS. 2-4 will be presented. The vehicle 58 (refer initially to FIG. 6) is only partially shown and includes a top conveyor 60 mounted to a main frame 62 having wheels 64 (only one shown). The frame 62 of FIG. 6 would be similar in construction to the frame 22 and would have separate right and left halves (not separately shown) connected by crossbars in similar fashion to the arrangement shown in FIG. 5. The vehicle 58 of FIGS. 6 and 7 is different from the vehicle 16F in that each end of the vehicle 58 (only one end is shown in FIG. 6) includes two inclined conveyors. For example, FIG. 6 shows a first lifting conveyor 66 and a second lifting conveyor 68. The upper end of conveyor 68 could be linked to the conveyor 60 in similar fashion to the linkage between conveyor 30 and conveyor 46 in FIG. 5. Additionally, and considering also FIG. 7, the right and left conveyor chains 68R and 68L are connected to the right and left conveyor chains 66R and 66L by way of sprockets 70 and 72 mounted to shaft 74 which rotates with the sprockets 70 and 72. The rotatable shaft 74 is secured to the frame 62 (not shown in FIG. 7) by way of journals 76. Note that the use of common drive shafts such as 74 between conveyors 66 and 68 and a similar common drive shaft between conveyors 68 and 60 allows one to use a single hydraulic motor (not shown in FIGS. 6 or 7, but similar to motor 42 of FIG. 5) at any shaft corresponding to conveyors 66, 68, and 60. In other words, a drive motor may be located at the interface between 66 and 68, the interface between 68 and 60, or even at the right end (not visible in FIG. 6 of conveyor 60 and the linkage together between the conveyors similar to that shown by sprockets 38 and 44 in FIG. 5 will drive all of the conveyors on a particular end of the vehicle 62. A separate hydraulic motor might be used to drive the two or three conveyors at the opposite end of the vehicle 58, which conveyors would be separated from the illustrated conveyors by a gap such as gap 50 of FIG. 2.

As shown in FIG. 7, the conveyor chains 66R and 66L extend to an idler wheel 78 and are constrained by a series of rollers 80 (only one shown on each side) which keep the upper run of the chains 66R and 66L from sagging under the weight of any ties. The idlers 78 and rollers 80 are mounted to a side member 66S of the conveyor 66 and various cross members 66C (only a few shown) extend between the two side members for structural strength. Extending downwardly from one of the cross members 66C are members 82 upon which a conveyor rolling shaft 84 is rotatably mounted, the shaft 84 having wheels 86 at opposite ends. The wheels 86 are used to engage the rails 12.

With reference to both FIGS. 6 and 7, a member 86 is fixed to the frame 62 and has a hydraulic cylinder 88 pivotably mounted to it. An opposite end of the hydraulic cylinder 88 is pivotably mounted to one of the cross members 66C such that, upon extension of the hydraulic cylinder 88, the lower conveyor 66 will rotate about the rotation axis or central axis shaft 74. In other words, the wheels 86 will lift off the rails 12 and conveyor 66 will rotate into an upper or inoperative position. In that fashion, the vehicle 58 may move more quickly along the track when the conveyor 66 does not need to pick up the ties. Although a single hydraulic cylinder 88 has been shown, one might alternately use right and left side hydraulic cylinders to rotate the conveyor 66 back into an upper and inoperable position.

Although the above has described conveyors 66 and 68 as first and second lifting conveyors for picking up ties from the top of rails and carrying them to the top of vehicle 58, the end of vehicle 58 which is not shown in FIG. 6 may also use two inclined lowering conveyors having the same structure as conveyor 66 and 68. If desired, one could make the lifting conveyor or conveyors at one end and the lowering conveyor or conveyors at an opposite end of the vehicle in such a way that the conveyors at either end could be used for lifting and the conveyors at either end could be used for lowering depending upon the direction in which the conveyors are being driven.

Although the arrangement of FIGS. 6 and 7 has shown two inclined conveyors, one of which is rotatable to an upper inoperable position, one could alternately use a single inclined conveyor at the end of the vehicle 58 and have the conveyor include side members such as 66S (FIG. 7) and a hydraulic jack such as 88 such that the single such conveyor could be rotated into an upper inoperable position.

FIG. 6 also shows a rolling frame 90 which will be discussed in more detail below.

Figure 9:
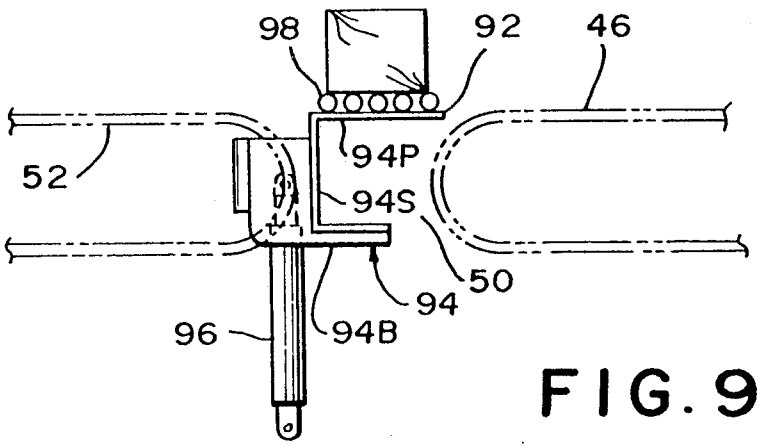
FIG. 9 shows a side view of the mechanism of FIG. 8 with the mechanism in a lower position.
Figure 10:
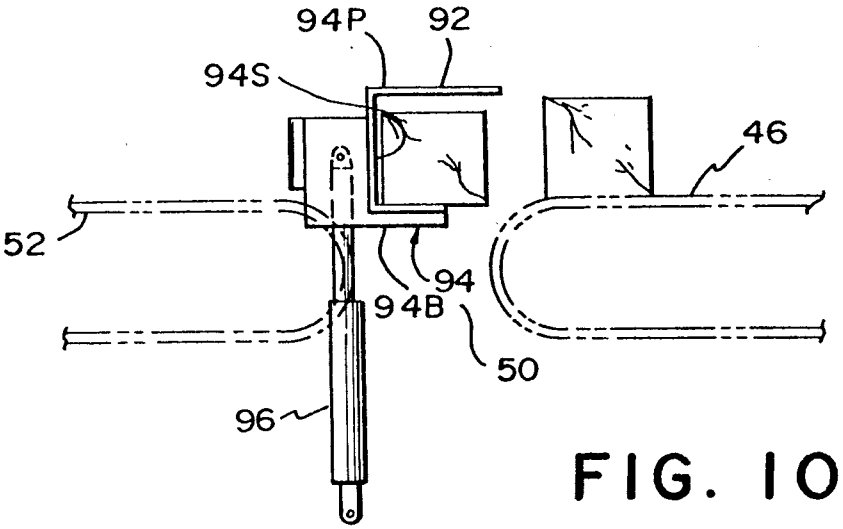
FIG. 10 shows a side view similar to FIG. 9 except that the mechanism is in an upper position.
Figure 8:
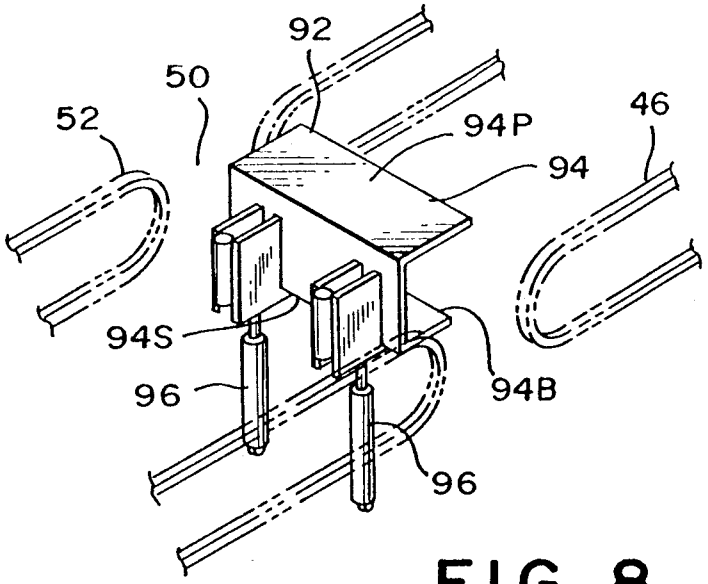
FIG. 8 shows a perspective of a tie elevator or transfer mechanism of the present invention.

With reference now to FIGS. 8–10, the transfer structure 92 according to the present invention will be discussed. As mentioned above, the transfer structure 92 is used to allow ties to pass over the gap 50 between conveyors 52 and 46 (refer back momentarily to FIG. 2). In particular, the transfer structure 92 includes a plate 94P which is part of a member 94 also having a bottom plate 94B and a planar stop portion 94S extending between the bottom plate 94B and the top plate 94P. Attached to move the member 94 up and down are two hydraulic cylinders 96 having lower ends fixed to the frame 22 (frame not shown in FIGS. 8–10).

When the hydraulic cylinders are retracted, the member 94 is in a lower position (FIGS. 8 and 9) such that the upper plate 94P essentially covers the gap 50. The transfer structure may optionally further include a series of rollers 98 (FIG. 9 only) which are rotatably mounted at the top of the plate 94P. A tie such as that illustrated in FIG. 9 which is carried to the gap 50 by conveyor 46 will be deposited upon the rollers 98. Upon the next tie being brought to the gap 50 by conveyor 46 (the next tie is not shown), the second or next tie will push the proceeding tie sufficiently far that the conveyor 52 will grab it and carry it away. In other words, the rollers 98 and plate 94P serve as a transfer structure 92 to move ties from the first top conveyor to the second top conveyor 52. Referring back momentarily to FIG. 1, this allows the first tie replacement vehicle 16F to proceed through the second zone while ties which have been deposited on top of the rails in front of the first vehicle 16F pass over top of the first vehicle and are redeposited on top of the rails behind the first vehicle.

When the first vehicle 16F in FIG. 1 reaches the first zone, it is necessary for the first vehicle to begin to retain or store ties upon the vehicle for use by that inserter vehicle. Accordingly, the hydraulic cylinders 96 are extended to lift the member 94 to the position shown in FIG. 10 whereby a tie will be retained above bottom plate 94B and against the stop 94S. As the conveyor 46 will be a friction conveyor (i.e., it does not include fingers to positively grip the ties), additional ties may back up against the tie in the member 94 and the conveyor 46 may keep turning with such additional ties simply staying in place and allowing slippage of the conveyor 46 relative to the ties. That portion of the conveyor 46 where the ties will back up may be considered as a support means for supporting ties on the vehicle for use by the vehicle.

It should be noted that the views of FIGS. 8–10 are simplified in that the necessary drive sprockets or idler wheels have not been shown corresponding to the ends of the conveyor chains which constitute conveyors 46 and 52. Additionally, the frame members to which the conveyors 46 and 52 are mounted have been left out for ease of illustration.

As will be discussed in more detail below, the retraction of the cylinders 96 with a tie loaded in the member 94 will lower the tie to in between the conveyors 46 and 52 such that a tie clamp on a tie inserter head (not shown in FIGS. 8–10) can grip the tie and use it as a new or replacement tie for replacing a selected tie under the rails. When this occurs, the conveyor 46 would of course be turned off such that any ties backed up on it would remain stationary.

Figure 10B:
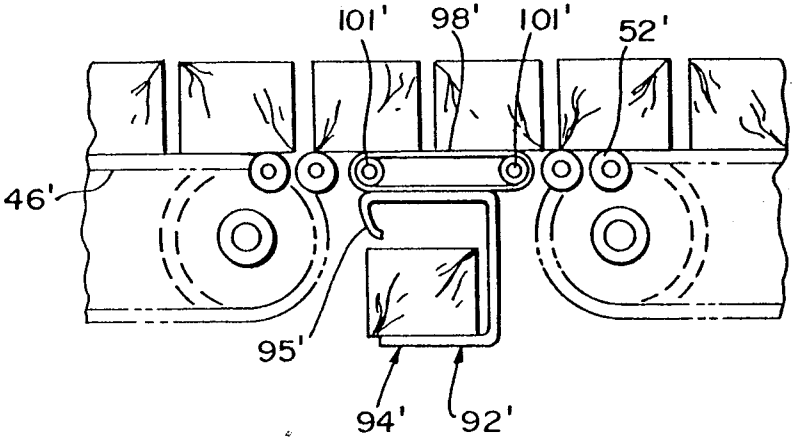
FIG. 10B shows a side view of the mechanism of FIG. 10A.
Figure 10A:
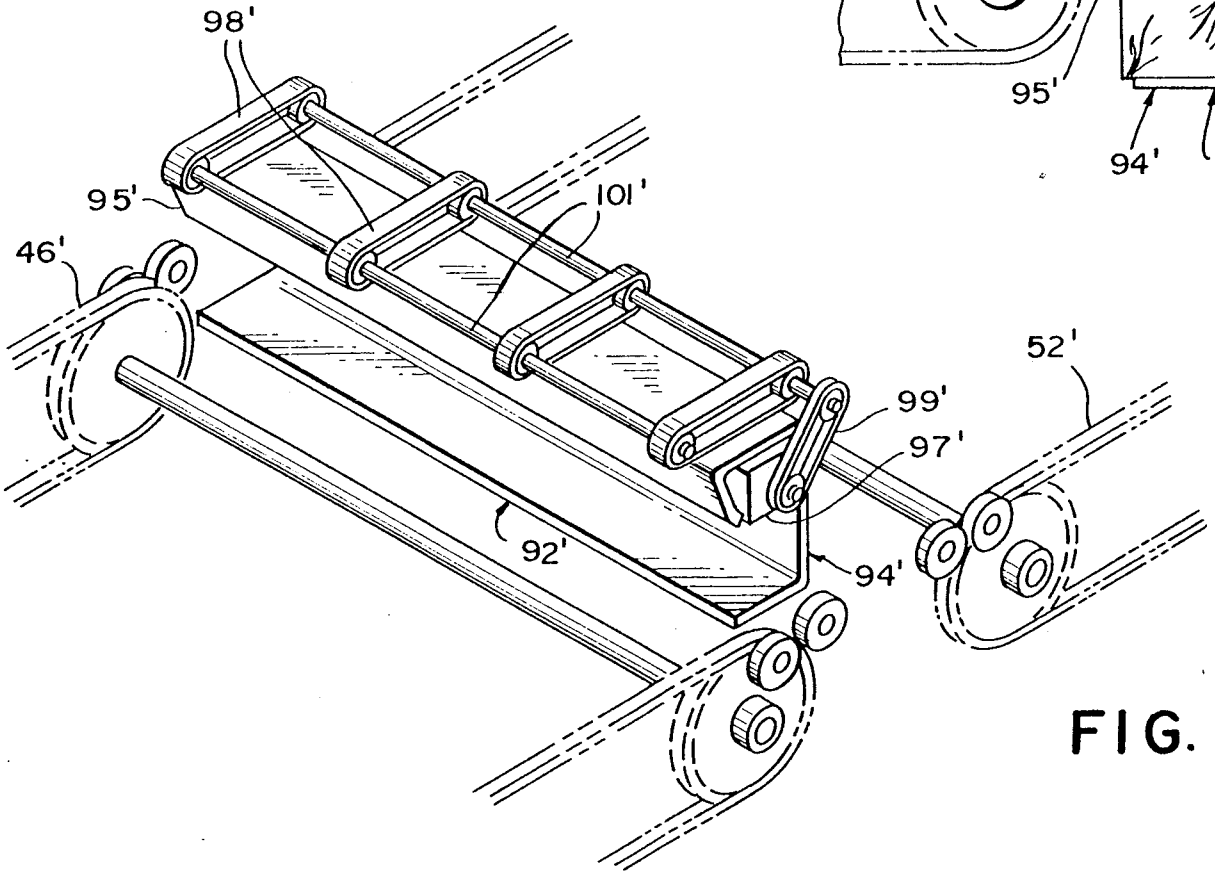
FIG. 10A shows a perspective view of an alternate tie elevator or transfer mechanism according to the present invention.

As an alternative to the arrangement of FIG. 9 and FIG. 10, FIGS. 10A and 10B show a transfer structure 92' which may extend between the conveyor 46' and the conveyor 52'. Each of the conveyors 46' and 52' is constructed essentially as discussed above for conveyors 46 and 52. The transfer structure 92' includes a plate 94' having a portion 95' which is slanted down and back away from the direction of flow of the ties as illustrated in FIG. 10B. A small conveyor includes belts 98' disposed upon the illustrated rollers and shafts, which shafts would be rotatably supported (supports not shown) on top of the plate 94'. The conveyor belts 98' would be rotated by way of motor 97' and drive belt 99' (FIG. 10A only).

When the transfer structure 92' including plate 94' is in the lower position of FIG. 10B, the conveyor 98' turning on rollers 101' may carry ties across the gap from the conveyor 46' to the conveyor 52'. Note that the views of FIGS. 10A and 10B are from the opposite side as the view of FIGS. 9A and 9B. When it is desired to load ties within the transfer structure 92' so that ties may be installed by the overall machine, the transfer structure 92' is raised by use of cylinders (not shown) such as 96 in the arrangement of FIGS. 8–10. The shape of the portion 95' minimizes the chances that the plate 94' will catch on a tie disposed at the edge of conveyor 46' when the plate 94' is lowered.

Figure 11:
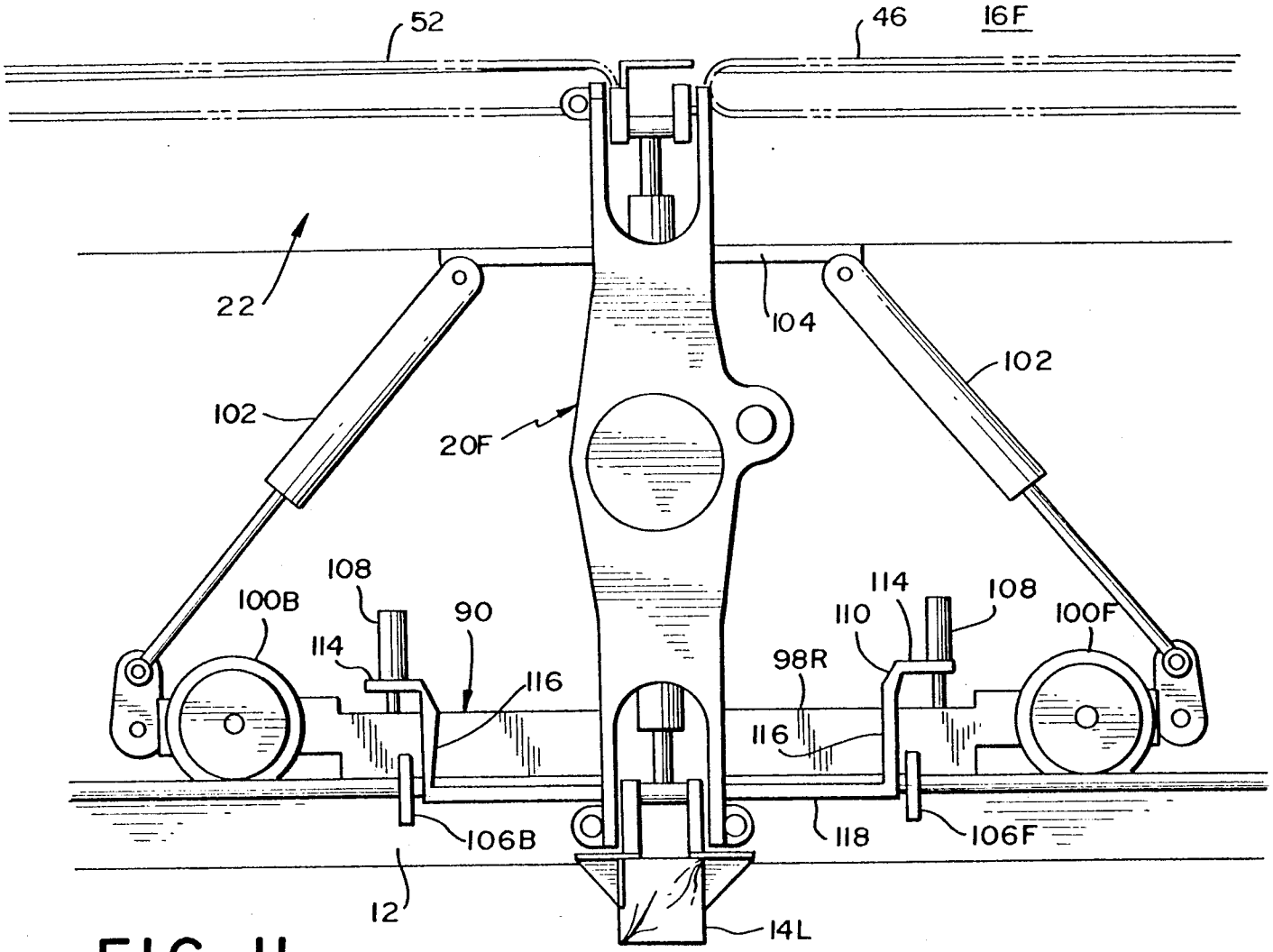
FIG. 11 shows a side view of a portion of the vehicle of the present invention having a tie inserter head and rolling frame mounted thereto.

With reference now to FIG. 11, the rolling frame 90 will be discussed in more detail. The rolling frame 90 includes lengthwise extending side members 98R and a similar left side member (not visible in the side view of FIG. 11). The two side members such as 98R may be connected by cross members (not shown, but essentially similar to cross member 66C in FIG. 7 or cross member 22C in FIG. 5). Mounted to the rolling frame 90 is a pair of front rolling frame wheels 100F and a pair of back wheels 100B (only one wheel of each pair is visible in FIG. 11). Attached to each of the side member 98R is a rail lift cylinder 102 having an upper end secured to plate 104. Although not shown in FIG. 11, it will be appreciated that an additional two hydraulic rail lift cylinders are disposed at each end of the left side member which corresponds to right side member 98R. Attached to each of the side members such as 98R are front and back rail clamps 106F and 106B. The rail clamps are shown only generally, it being understood that such rail clamps may be constructed similar to the rail clamps 86 of FIG. 6 of U.S. patent application Ser. No. 240,516 filed Sept. 6, 1988, now U.S. Pat. No. 4,951,573, in the name of Harry Madison, entitled "TIE REMOVER AND INSERTER", assigned to the assignee of the present application, and hereby incorporated by reference. Such rail clamps include an inner and outer jaw and one or more hydraulic cylinders for clamping the rail in between the jaws or clamp faces. For ease of illustration, only the outer clamp members 106F and 106B are shown in FIG. 11. It should be also appreciated that similar rail clamps are mounted on the left side member which is opposite and identically constructed to the right member 98R.

Figure 12:
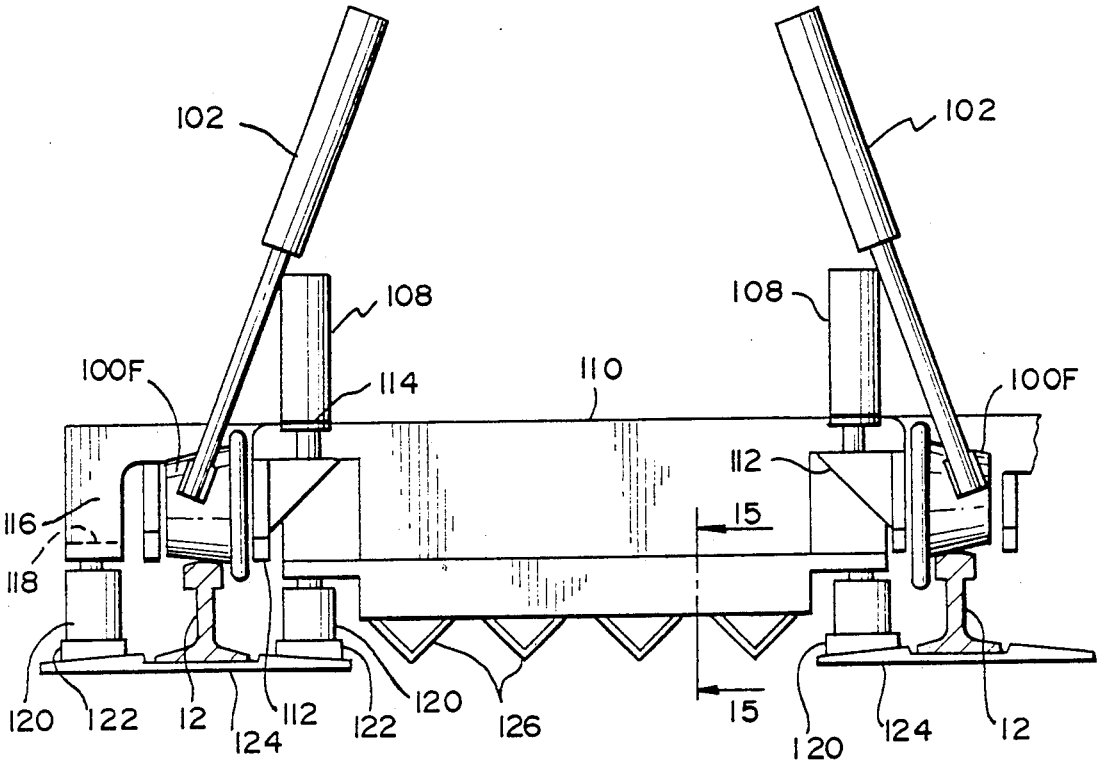
FIG. 12 shows an end view of a tie plate holding and tie guide structure according to the present invention.

Continuing to view FIG. 11 but also considering the end view of FIG. 12, four tie guide assembly lift cylinders 108 are used to lower and lift a tie guide assembly 110 relative to the rolling frame 90. If desired, the cylinders could be mounted at an angle (lower ends tilted towards the adjacent field side) to help resist movement. Of course, only two of the hydraulic cylinders 108 are visible in the side view of FIG. 11 and only two of the cylinders 108 are visible in the front or end view 12. Each of the hydraulic cylinders 108 has a lower end secured to the member 112 (FIG. 12 only) which in turn is part of or fixed to the rolling frame 90. (For ease of illustration, other portions of the rolling frame 90 and some portions of the assmebly 110 have not been illustrated. The assembly 110 includes members 114 (see especially FIG. 11) attached to move up and down when the tie guide assembly lift cylinders 108 are retracted and extended. Extending down from the members or portions 114 are portions 116 having a lower portion 118 extending therebetween (see especially FIG. 11 and phantom lines at least side of FIG. 12). The lower portion 118 has electromagnets 120 mounted thereon (see FIG. 12), the electromagnets 120 are not visible from the view in FIG. 11 because they are blocked by portions of the tie inserter mechanism 20F.

Figure 13:
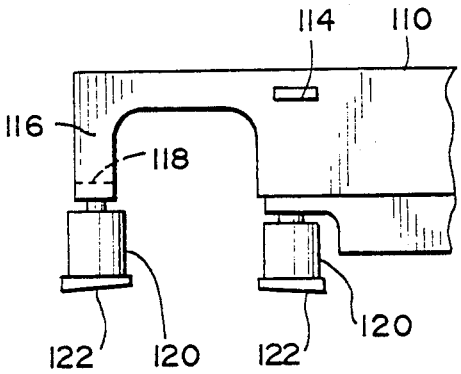
FIG. 13 shows an enlarged end view of a portion of the tie plate holding and tie guide assembly.
Figure 14:
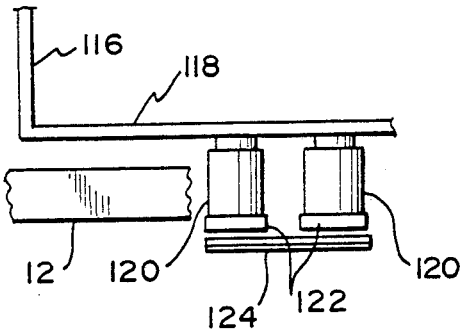
FIG. 14 shows a side view of a portion of the structure of FIG. 13.

Continuing to view FIG. 12 but also considering the end view of FIG. 13 and the side view of FIG. 14, each of the electromagnets 120 has a pole piece 122 attached thereto and, as best shown in FIGS. 12 and 13, the pole pieces 122 are tapered to match the tie plates 124. As best seen in FIG. 14, the electromagnets 120 and pole pieces 122 are disposed in pairs with the two electromagnets 120 shown in FIG. 14 being on the field side of rail 12. In similar fashion, a pair of electromagnets 120 are disposed on the gauge side of each rail and another pair of electromagnets 120 would be disposed on the field side of the opposite rail from that shown in FIG. 14. When the electromagnets 120 in FIG. 14 are activated, a magnetic circuit is completed through the pole pieces and the tie plate 124, thereby holding the tie plate 124 against the pole pieces 122. At the same time, the corresponding pair of gauge side electro-magnets would be activated such that the tie plate 124 shown at the left side of FIG. 12 would be pulled towards, and possibly held against, the pole pieces 122 corresponding to four of the electromagnets. At the same time, the tie plate 124 on the right side of FIG. 12 would likewise be pulled upwardly by two field side electromagnets (not shown in FIG. 12) and two gauge side electromagnets. The electromagnets will be used to secure the tie plates 124 against the underside of the rails 12 when the rails 12 are lifted in a manner described in more detail below.

Figure 15:
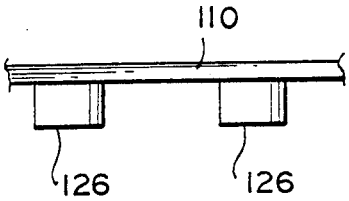
FIG. 15 shows a simplified cross section view taken along lines 15—15 of FIG. 12.

With reference now to FIG. 15 in conjunction with FIG. 12, it will be noted that a series of tie guide members 126 are disposed as shown to define a channel therebetween and may be used to channel a replacement tie into the proper position.

Figure 16:
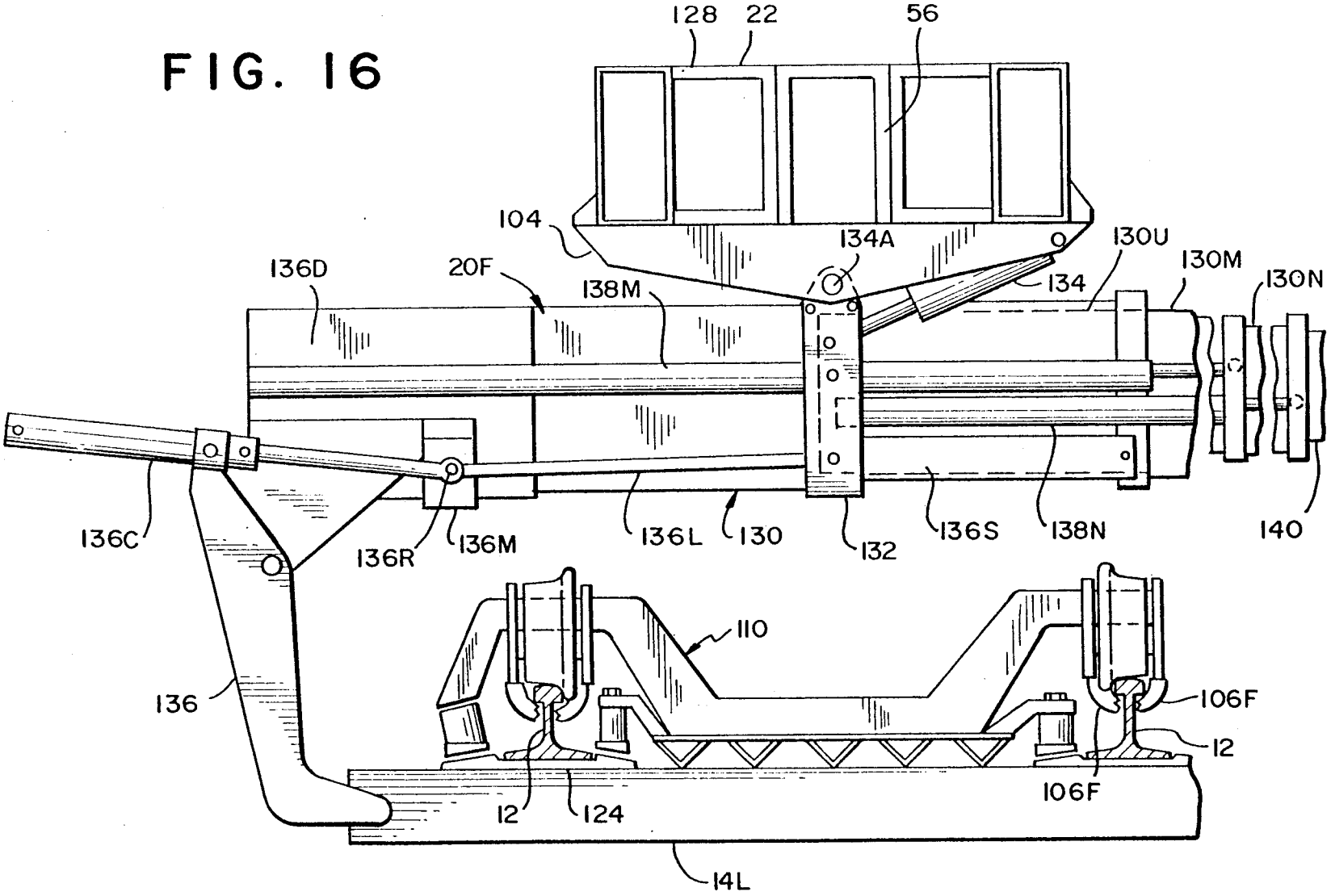
FIG. 16 shows an end view of a boom and related structure according to the present invention.

With reference now to FIG. 16 and also referring to FIG. 11, the tie inserter mechanism 20F and the rolling frame 90 (together with tie guide assembly 110) are mounted to the main frame 22 by way of plate or member 104. As shown in FIG. 11, the hydraulic cylinders 102 are secured at one end to the plate 104, but for ease of illustration, these hydraulic cylinders 102 are not shown in FIG. 16. The plate 104 is fixed to a pivot shaft 56 which is pivotably attached to a portion 128 of main frame 22. Accordingly, and using known turntable techniques and/or mechanisms, the shaft 56 together with plate 104, rolling frame 90 including tie guide assembly 110, and tie inserter mechanism 20F can be rotated relative to the main frame 22. This will be discussed in more detail below with respect to FIGS. 25A and 25B.

As best shown in FIG. 16, the inserter mechanism 20F includes a boom assembly 130 pivotably secured to plate 104 by front and back downwardly extending members 132 (only one of which is visible in the front view of FIG. 16). Specifically, front and back hydraulic cylinders 134 (the front one is visible in FIG. 16, it being understood that a similar back cylinder will be constructed in mirror image fashion). By retracting and extending the cylinders 134, one can rotate the boom assembly 130 about a generally horizontal axis 134A which extends parallel to the rails 12, this direction also corresponding to the lengthwise direction of the vehicle.

The boom 130 includes a kicker 136 operated by hydraulic cylinder 136C and used to push an old tie 14L at one of its ends such that it may be better pulled at the other of its ends. The kicker 136 may be constructed and operable in essentially identical fashion to that shown in the above incorporated by reference Madison application. Additionally, however the kicker 136 may be slid horizontally by a kicker/slide cylinder 136S moving the rod 136R of cylinder 136C by way of member 136M moving along a kicker slide 136D.

The boom 130 further includes an outer boom section 130U, a middle boom section 130M, and an inner boom section 130N. A middle boom hydraulic cylinder 138M moves the middle boom section 130M relative to the outer section 130U. An inner boom hydraulic cylinder 138N is used to extend the inner boom section 130N.

As shown in FIG. 16, the end of the boom 130 includes a member 140. Reference now to FIGS. 17 and 18, the structure of a tie inserter head assembly 142 will be discussed in detail. The tie inserter head 142 is mounted to the member 140 of FIG. 16. More specifically, a valve mount 144 is fixed in position at the member 140 (member 140 not visible in FIGS. 17 and 18). Attached to the valve mount 144 is a planetary gear 146 powered by a motor 148 as shown in FIG. 17. The planetary gear 146 meshes with a ring gear 150 (having stops to allow 180° of rotation) which is fixed to the tie inserter head 142 upon the hydraulic motor 148 causing planetary gear 146 to rotate, the ring gear 150 will rotate about central axis 150C. This in turn causes rotation of the tie inserter head 142 relative to the valve mount 144 and relative to the vehicle itself. It will be appreciated that the rotation axis 150C is horizontal when the boom 130 is horizontal. More specifically, the axis 150C is parallel to the lengthwise direction of the boom 130 (refer back momentarily to the FIG. 16) and is perpendicular to or transverse to the rails 12. Disposed at one end of the tie inserter head 142 is a first tie clamp 152 having a hydraulic cylinder 152C, which when activated causes the opposing jaw faces 152F to rotate about axes 152A and clamp or release a tie disposed between the faces 152F. Jaw 152 may be basically similar to various previously used jaws. However, it should be noted that the faces 152 will be planar members which may clamp a tie therebetween. Further, the jaws include tie end stop plates 152E. The use of the tie end stop plates 152E to prevent a tie from sliding too far relative to the jaw 152 will be more apparent with reference to FIG. 17A showing a part of a tie 14S which will abut the end plate 152E before the tie 14S could slide too far.

In addition to the jaws 152 mounted at one end of the tie inserter head 142, the opposite end of the head 142 includes a tie clamp 154 having a hydraulic cylinder 154C (only the rod is visible in FIG. 18). For ease of illustration, FIG. 17 does not include the components of the tie clamp 154. The tie clamp 154 includes jaws 154J which rotate about axis 154A to clamp a tie (not shown) in between the illustrated jaw 154J and a corresponding or opposing (not shown in FIG. 18, but the opposing jaw would be behind and identically constructed to the illustrated jaw). The opening and closing of the jaw 154 can be accomplished using known techniques for rail clamping.

Operation of the tie replacement vehicle 16F for allowing tie passage over the vehicle has been discussed above in connection with FIG. 1. The operation of the vehicle for replacing a particular tie will now be discussed.

The vehicle 16F would be moved until the tie inserter head 20F is disposed over a particular tie which is to be replaced. Additionally, any spikes, anchors, or other fasteners would have been previously removed. The tie inserter head 20F being disposed over the particular tie which is to be replaced, the hydraulic cylinder 134 (refer to FIG. 16) is activated to orient the boom 130 horizontally and such that the clamp 154 will be lowered to a position such that the tie clamp 154 can clamp the old tie disposed underneath the rails. Before an old tie is clamped, the rail clamps 106F and 106B (see FIG. 11) will have been activated by the lowering of the tie guide assembly 110 by operation of the hydraulic cylinders 108. The tie guide assembly 110 (refer to FIG. 12) is lowered and the electro-magnets 120 are activated to hold the tie plates 124 or pull the tie plates 124 against the underside of the rails 12. The hydraulic cylinders 102 (FIG. 12) are activated to lift the rolling frame 90 (refer to FIG. 11) and, by way of the rail clamps 106F and 106B, lift the rails 12 adjacent the particular tie which is to be replaced. At that stage, the old tie clamp 154 is activated to clamp the old tie 14L as shown in FIGS. 19A, 19B, and 19C.

Figure 21A:
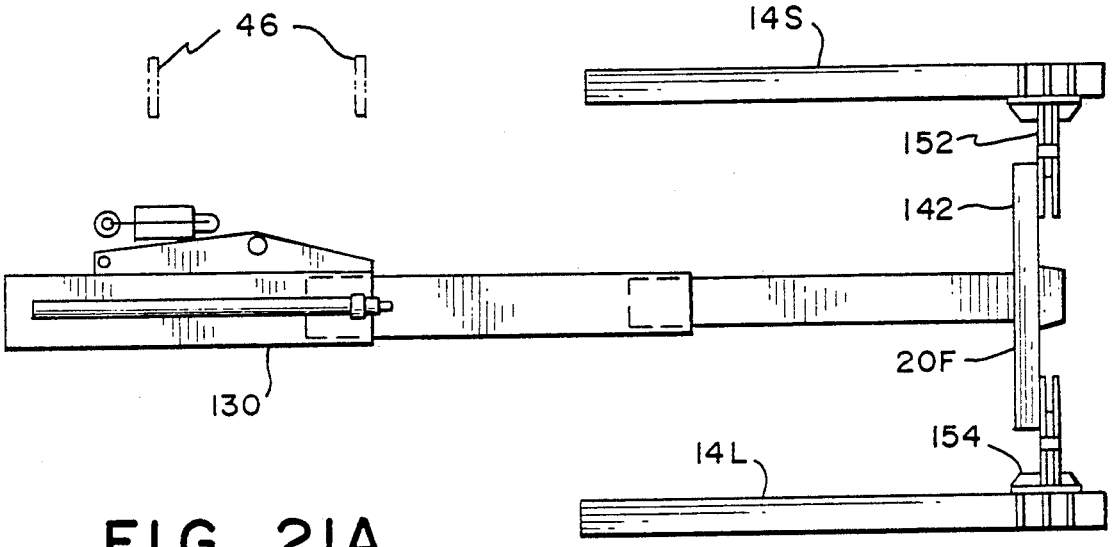
FIG. 21A and FIG. 21B respectively show a back view and a perspective view of the boom and tie inserter mechanism in a particular position and state.
Figure 21B:
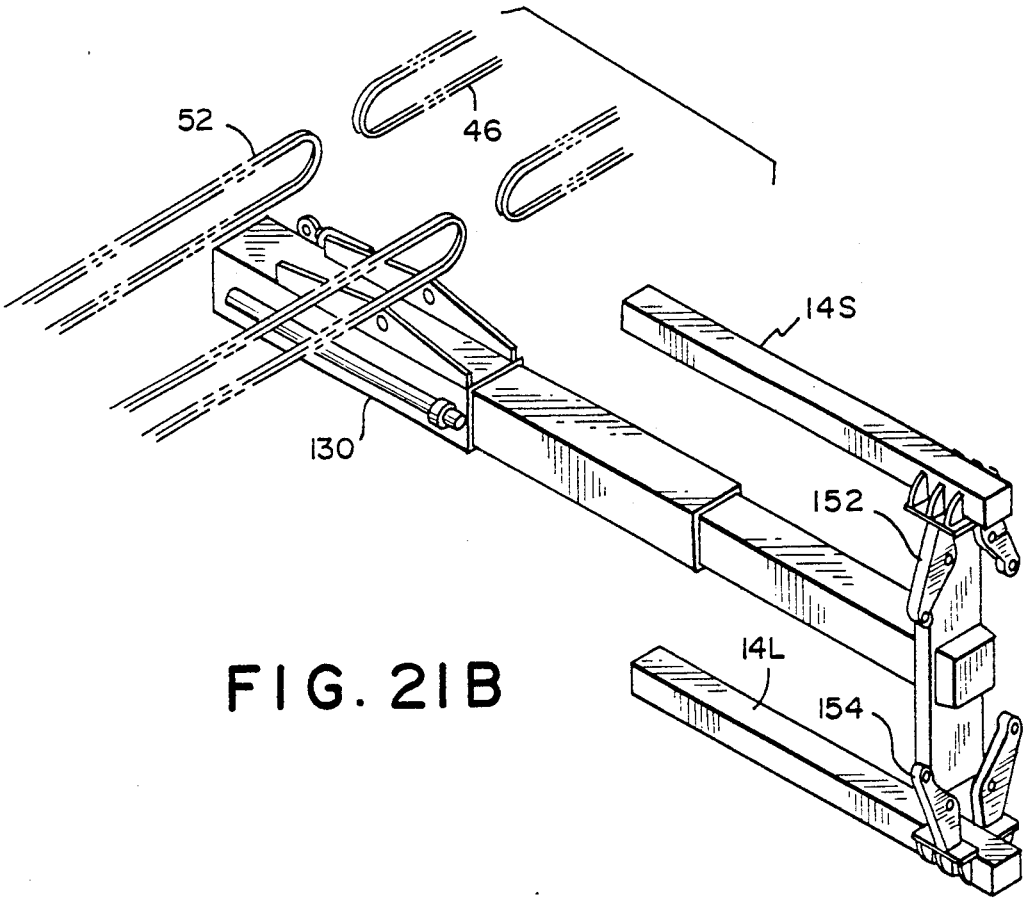

New tie 14S is then lowered by operation of the hydraulic cylinders 96 and movement of the member 94 (refer back to FIG. 10). For ease of illustration, FIGS. 19A, 19B, and 19C, as well as the higher numbered figures discussed below have not included the member 94. Once the tie 14S is lowered into the position shown in FIGS. 20A and 20B, the new tie clamp 152 is activated to clamp the new tie as shown in these two figures. With reference now to FIGS. 21A and 21B, the boom 130 is now extended such that the old tie clamp 154 pulls the old tie 14L out from under the rails (rails not shown). A kicker 136 (refer back to FIG. 16, not shown in FIGS. 21A and 21B) could be used to push the old tie 14L during the removal process. At the same time, the extension of boom 130 pulls the new tie 14S out from over top of the rails and to the side of the rails. Thus, a single boom extension is used for the old tie and the new tie in order to save time.

From the position in FIG. 21A and 21B, the member 142 is then rotated to the position shown in FIG. 22, this rotation being accomplished by the motor 148 (refer back momentarily to FIG. 17). Upon rotation to the position shown in FIG. 22, the old tie clamp 154 is opened such that the old tie 14L may drop free of the clamp. The old tie would then be disposed along the side of the road bed. From the position in FIG. 22, the tie inserter head 142 is rotated further until the new tie clamp 152 is disposed below the boom 130. At that stage, the boom 130 is retracted thereby inserting the new tie 14S below the rails 12 (not shown) of this retracted position being illustrated in FIG. 23. As the boom 30 retracts, the new tie 14S will be aided in positioning by the tie guide assembly 110 shown in FIGS. 12 and 16.

Figure 24:
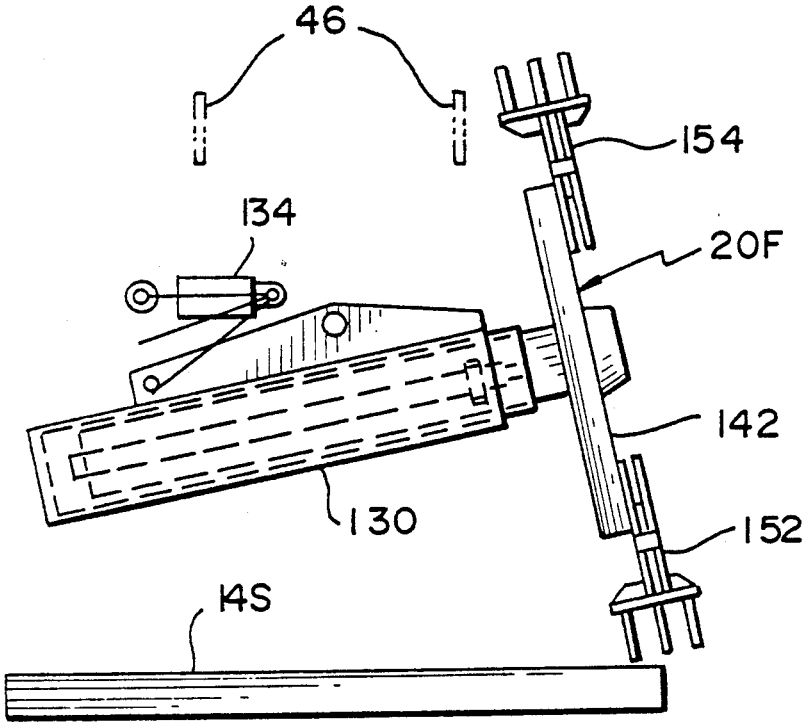
FIG. 24 is a back view of the boom and tie inserter mechanism in yet another position.

Following the insertion of the new tie 14S, the new tie clamp 152 is released. The boom tilt cylinder 134 is activated to lift the boom 130 to the position shown in FIG. 24, the tie inserter head 142 may be rotated back to its original position with the new tie clamp 152 at the top and the old tie clamp 154 at the bottom. That position, shown in FIG. 24, would be obtained by operation of the motor 148 (see FIG. 17) operating the planetary gear 146 which in turn rotates the ring gear 150. The ring gear 150 may have adjustable stops 180° apart.

After the insertion of the new tie 14S in the manner described above, hydraulic rolling frame lift cylinders 102 may be activated to lower the rolling frame 90 (see FIG. 11). Lowering of the rolling frame 90, the frame 90 is no longer holding the rails 12 up. Accordingly, the rail clamps 106F and 106B (FIG. 11) May be released and, additionally, the electromagnets 120 may be turned off (see FIG. 12) and the tie guide assembly lift cylinders 108 may be activated to lift the assembly 110 (see FIG. 12). At that stage, the vehicle 16F is ready to move on until the tie inserter mechanism 20F is disposed over the next old tie which is in need of replacement.

As a variation on the process just discussed, the present invention also includes the use of a new tie in order to push out an old tie. In other words, one would secure a new tie and move it into the position of FIG. 21A without the need for securing an old tie such as 14L in FIG. 21A. If desired, the process might be accomplished using a tie inserter mechanism 20F modified from that of FIG. 21A such that only a single tie clamp 152 would be used. Alternatively, a tie inserter mechanism 20F with two identical tie clamps could be used with a lower tie clamp releasing a just-inserted tie and an upper tie clamp grabbing another new tie (for the next insertion, as needed) each time the boom is retracted and the upper and lower tie clamps sequentially changing positions. At any rate, this modified process would involve the situation where the ends of the old tie had been previously cleared of ballast. Under such circumstances, and assuming that both sides of the rails were relatively free of obstructions, the new tie 14S (refer to FIG. 23) could be pushed in place under the rails (not visible in FIG. 23) with the new tie 14S pushing out the old tie (not shown in FIG. 23) on the side of the track opposite where the new tie is being pushed in. This would further speed the processing of the tie replacement method. The tie plates would be held in place during the replacement and the rails would be clamped by use of the same steps as indicated above.

Figure 25A:
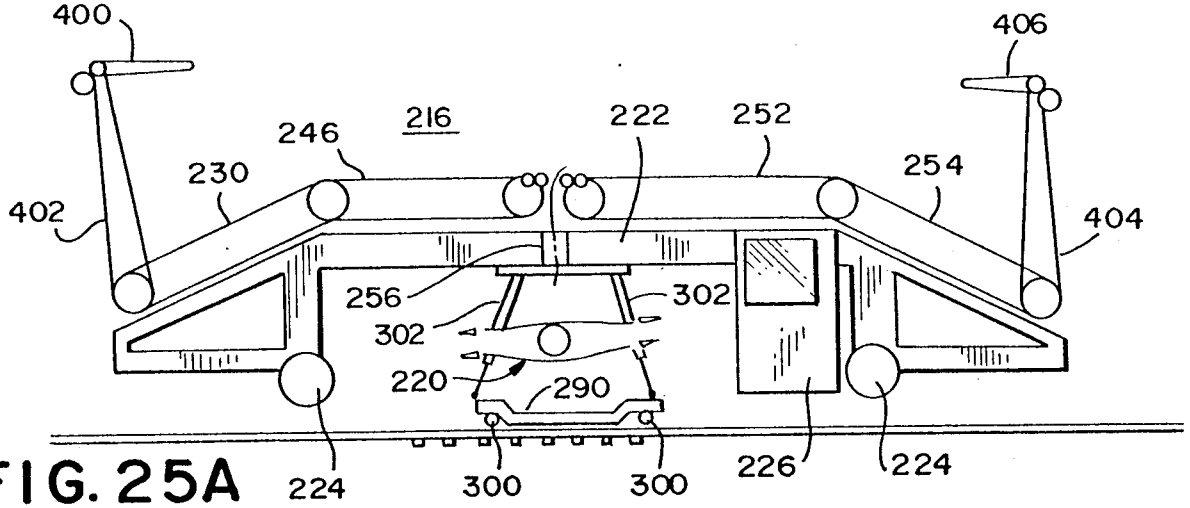
FIG. 25A shows a simplified side view of an alternate vehicle according to the present invention and in a position for rotating the main frame of the vehicle.
Figure 25B:
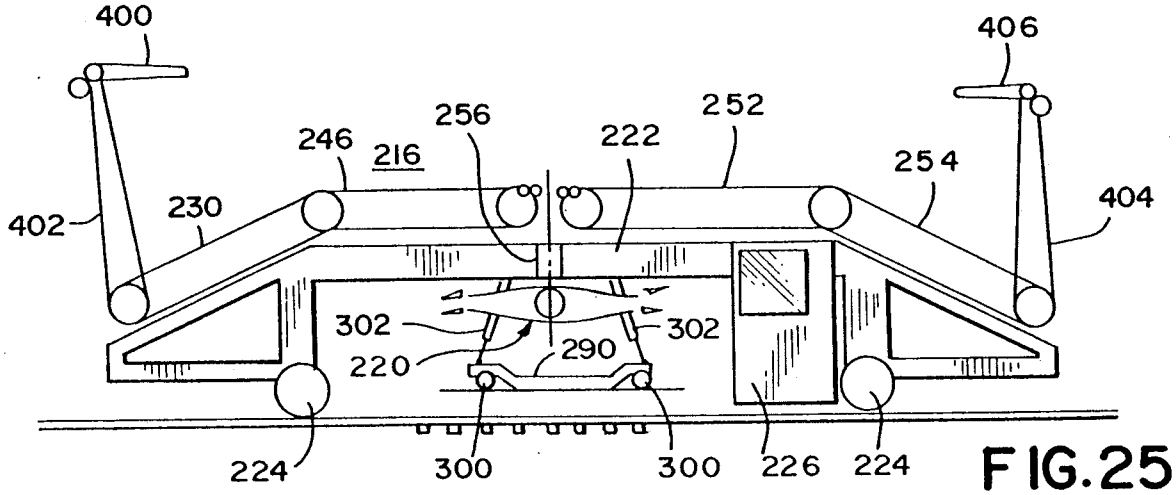
FIG. 25B shows a simplified side view of the vehicle of FIG. 25A and in position for rotating a rolling frame part of the vehicle.

With reference now to FIGS. 25A and 25B, there is shown a simplified side view of an alternate vehicle 216 according to the present invention. The components of the vehicle 216 have been labeled with numbers in the 200 series having the same last two digits for components having numbers under 100 in the previously discussed embodiment and in the 300 series for components corresponding to components in the previous embodiment which have numbers over 100. Thus the vehicle 216 includes a cab 226, wheels 224, and tie inserter mechanism 220 having rolling frame 290 with wheels 300 and rolling frame lift cylinders 302.

FIG. 25A shows an operation which the present invention may perform when it is desired to change the direction of travel of the vehicle 216. In particular, the rolling frame lift cylinders 302 are extended so as to lift the main frame 222. The wheels 300 remain on the rails while the wheels 224 are lifted together with the main frame 222 and associated parts. The main frame 222 and associated parts are then rotated relative to the rolling frame 290 about the shaft 256. Known turntable techniques may be used to provide this rotation. Upon rotating the main frame 222 about a half-circle (180°), the cylinders 302 may be retracted until the wheels 224 again rest upon the rails, the front and back of the vehicle 216 having been interchanged in position. Although not shown in FIG. 25A, the rolling frame 290 should be clamped to the rails using rail clamps (not shown in FIG. 25A) like the clamps 106F and 106B of FIG. 11. By rotating the main frame 222 while the rolling frame 290 remains stationary, one can change the direction of travel of the vehicle 216.

FIG. 25B shows how the tie inserter mechanism 220 and rolling frame 290 can be rotated about shaft 256 while maintaining the main frame 222 and associated parts of the vehicle stationary. In particular, the rolling frame lift cylinders 302 can be retracted until the rolling frame wheels 300 are raised above the level of the rails. The mechanism 220 and rolling frame 290 is then rotated 180° after which the cylinders 302 can be extended to bring the wheel 300 back to the rails. The rotation of the tie inserter mechanism 220 by lifting it and rotating about shaft 256 allows one to extend the boom (not separately shown in FIG. 25B) to either side of the track. Accordingly, if one side of the track has obstructions which might otherwise interfere with the extension of the boom (not separately labeled, the boom of tie replacer 220 would be identical to the boom 130 of FIG. 16), the rolling frame 290 can be rotated 180° such that the boom would have a clear path for extension on the opposite side of the track.

The cab 226 may have dual controls on opposite sides such that the operator can move from one side of the cab to the other side of the cab depending upon the side upon which the tie inserter mechanism 220 is to be operated.

The tie inserter mechanism 220 and rolling frame 290 of the embodiment of FIGS. 25A and 25B would be constructed in the same manner as the corresponding components previously discussed with respect to the structures of FIGS. 1–24. Indeed, the vehicle 216 is constructed as previously discussed with respect to vehicle 16F except that the conveyor system including conveyors such as 246 and 252 is mounted differently. Specifically, the conveyors 230, 246, 252, and 254 may be mounted by having journals or flanges (not shown) such as 76 in the previously discussed embodiment of FIG. 7 and having the shafts (not separately shown) at each end of the conveyors rotatably mounted to such journals or flanges. In other words, the journals or flanges project up from the main frame 222 and rotatably support the conveyors above the main frame 222.

In addition to the mounting of the conveyors upwardly from the main frame 222, the vehicle 216 has a conveyor system with a larger number of conveyors than the vehicle 16F. In particular, the front of the vehicle 216 includes conveyors 400 and 402 forward of the conveyor 230. Additionally, the back of the vehicle includes conveyors 404 and 406. As shown in the position of FIG. 25A, these conveyors 400, 402, 404 and 406 are in a retracted or travel position. When the vehicle 216 is operating, these four conveyors will be extended down to an operable position as will be discussed below. Since the structure of conveyors 400 and 402 is identical to that of conveyors 404 and 406, the discussion which follows will emphasize conveyors 400 and 402. The difference between the respective front conveyors 400 and 402 and the two back conveyors 404 and 406 is that the front conveyors lift ties onto the vehicle, whereas the back conveyors carry ties off of the vehicle.

Figure 26A:
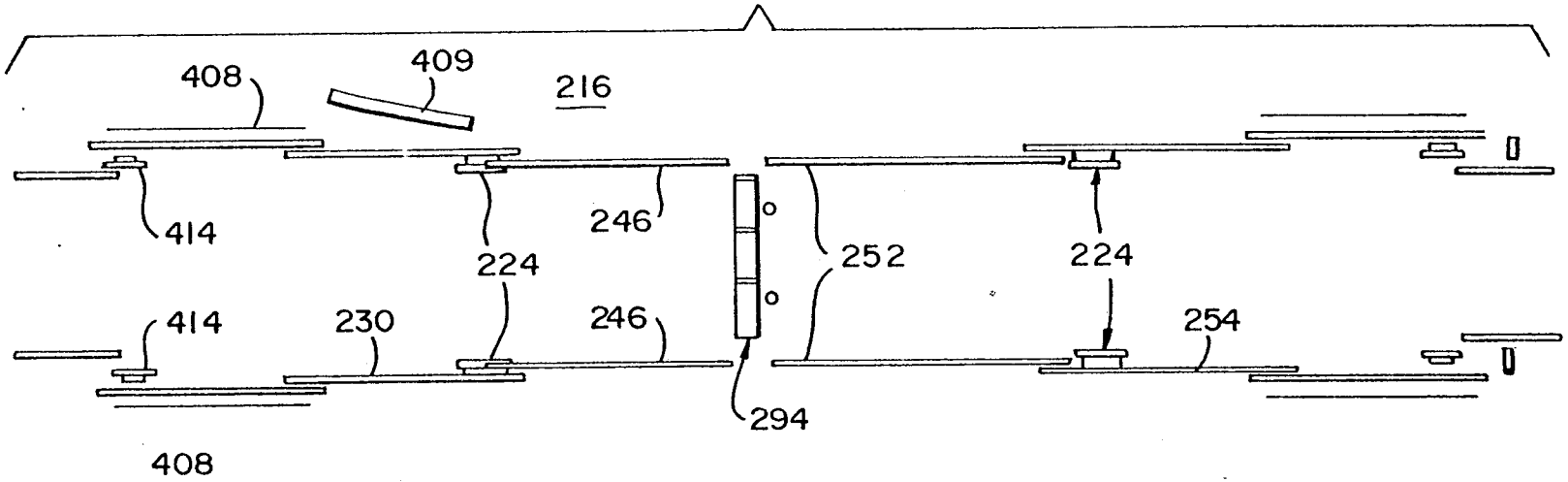
FIG. 26A shows a simplified top view of the vehicle of FIG. 25A.
Figure 26B:
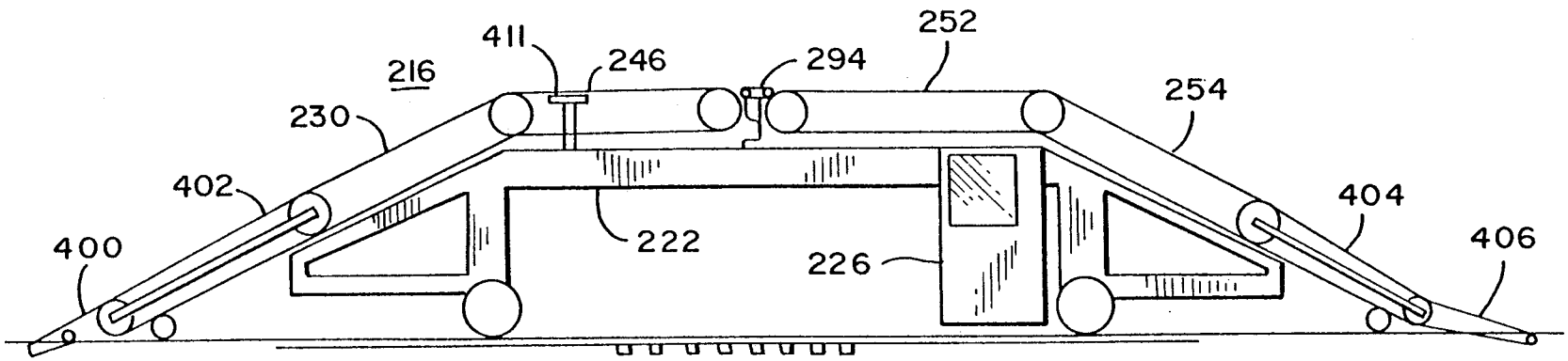
FIG. 26B shows a simplified side view of the vehicle of FIG. 25A.

With reference now to FIGS. 26A and 26B, there is shown respectively a simplified top view and a simplified side view of the vehicle 216. Numerous parts have been left out of the top view and the side view for ease of illustration. As shown, the tie feed elevator or transfer structure 294 is disposed in the gap between conveyor 246 and conveyor 252.

In the position of FIG. 26B, the conveyors 400, 402, 404, and 406 are in a lower position for conveying ties. Although the tie elevator or transfer structure 294 is shown in the lower position in FIG. 26B, it could also be raised to its upper position in the fashion discussed previously with respect to the earlier transfer structures.

As shown in FIG. 26A, a lateral tie guide 409 (only one shown) may be mounted upon each side of the conveyor 230 and have a relatively wide opening at its forward end (closest to wheels 414). The tie guides 409 center the ties (not shown in FIG. 26A) on conveyor 230 and would be fixed to the main frame 222 (not separately shown in FIG. 26A). In other words, the wide end of the pair of lateral tie guides 409 allow the tie to pass in between the guides 409. As the tie moves rightwardly in FIG. 26A, it will be centered by virtue of the slant or curvature in guides 409.

As shown in FIG. 26B, members 411 (only one shown) may extend up from the main frame 222 and have flat upper surfaces upon which the conveyor belts corresponding to conveyors 246 and 252 will be disposed. In other words, the members 411 could limit the extent of sag of the conveyor belts such as those on conveyors 230, 246, 252, and 254.

Figure 27:
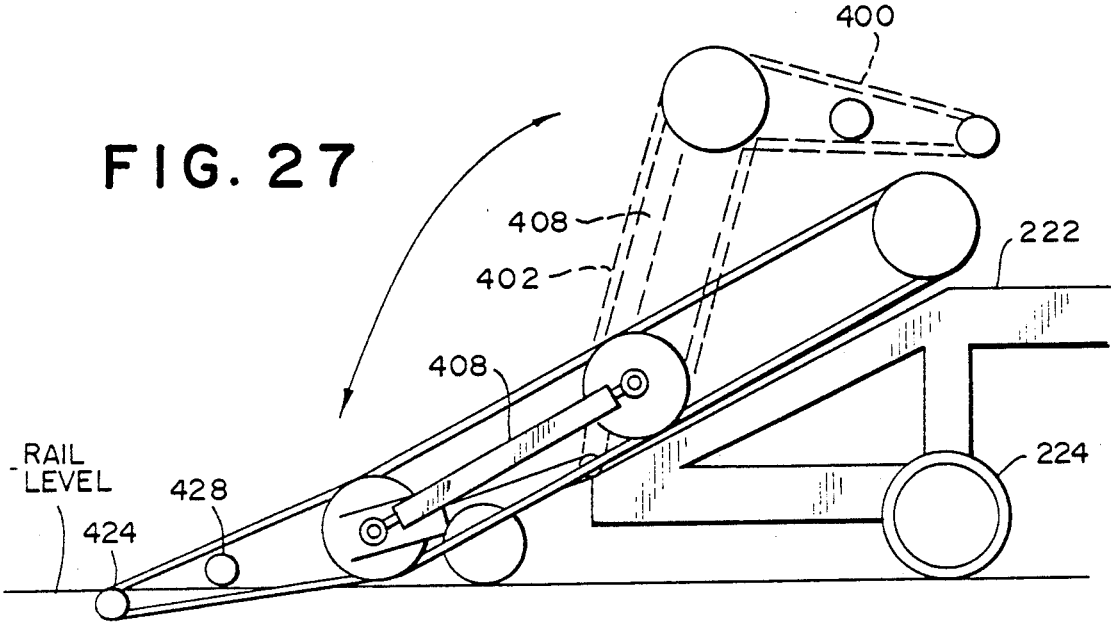
FIG. 27 shows a simplified side view of some of the conveyors of the arrangement of FIG. 25A.
Figure 28:
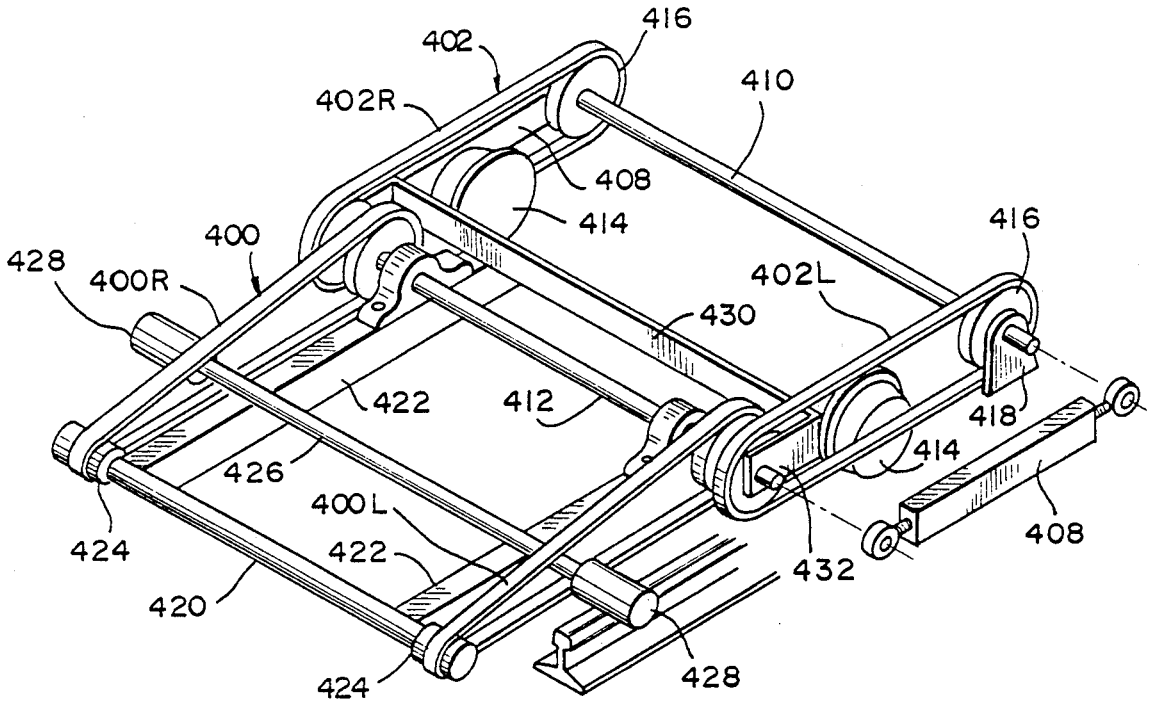
FIG. 28 shows a perspective view of the mechanisms of FIG. 27.

Continuing to view FIGS. 26A and 26B, and also considering the simplified side view of FIG. 27 and the perspective view of FIG. 28, more details with respect to the structure of conveyors 400 and 402 will be presented. In FIG. 27, the conveyors 400 and 402 are shown in their traveling or upper position in phantom line. In order to extend them down to a lower position shown in solid line in FIG. 27, a hydraulic cylinder arrangement (discussed below) or other system might be used. As shown in solid line in FIG. 27 and by way of the illustration of FIG. 28, the right and left runs 402R and 402L of conveyor 402 have adjustable side bars 408 extending alongside of the conveyor. The conveyor 402 extends from shaft 410 to shaft 412 and has rail engaging wheels 414 mounted thereon. The conveyor wheels 416 are rotatably mounted to a pair of flanges 418 (only one visible in FIG. 28) which would be secured to the front of the frame 222 (frame 222 in FIG. 27). The front conveyor 400 includes right and left conveyor belts 400L and 400R. Although not shown in FIG. 28, the various conveyor belts of conveyor 400 and conveyor 402 may include fingers such as 34 shown on the conveyor 30 of FIG. 5. The conveyor 400 has one end mounted to shaft 412 and an opposite end mounted to shaft 420. Shaft 420 is in turn mounted to members 422 and has rollers 424 mounted on its ends. The conveyor belts 400R and 400L extend around the rollers 424. Also mounted to members 422 is a rod 426 having free rollers 428 mounted at opposite ends thereof. As best shown in FIGS. 27 and 28, the free rollers 428 would roll along the top of the rails, whereas the rollers 424 would be disposed down below the top of the rails such that conveyor belts 400R and 400L may lift ties off the rail.

The adjustable side bars 408 are mounted on a mount bracket 430 having mount shafts 432 at opposite ends thereof (only one visible in FIG. 28). Continuing to consider FIG. 28, but also considering FIG. 29 and FIG. 30, the adjustable side bars 408 extend between pins 434 which limit the extent of play which the adjustable side bars allow the conveyor 402. In particular, the adjustable side bars 408 have spherical rod ends 436 and allow the conveyor 402 to follow curves in the rail upon which the vehicle is moving. Moreover, the conveyor belts 402R and 402L (refer back to FIG. 28) are flex chain conveyor belts which provide a certain degree of freedom in the vertical plane so that the rail engaging wheels 414 may track curves in the rails. The adjustable side bars 408 are made of metal to provide a certain flexibility.

Figure 29:
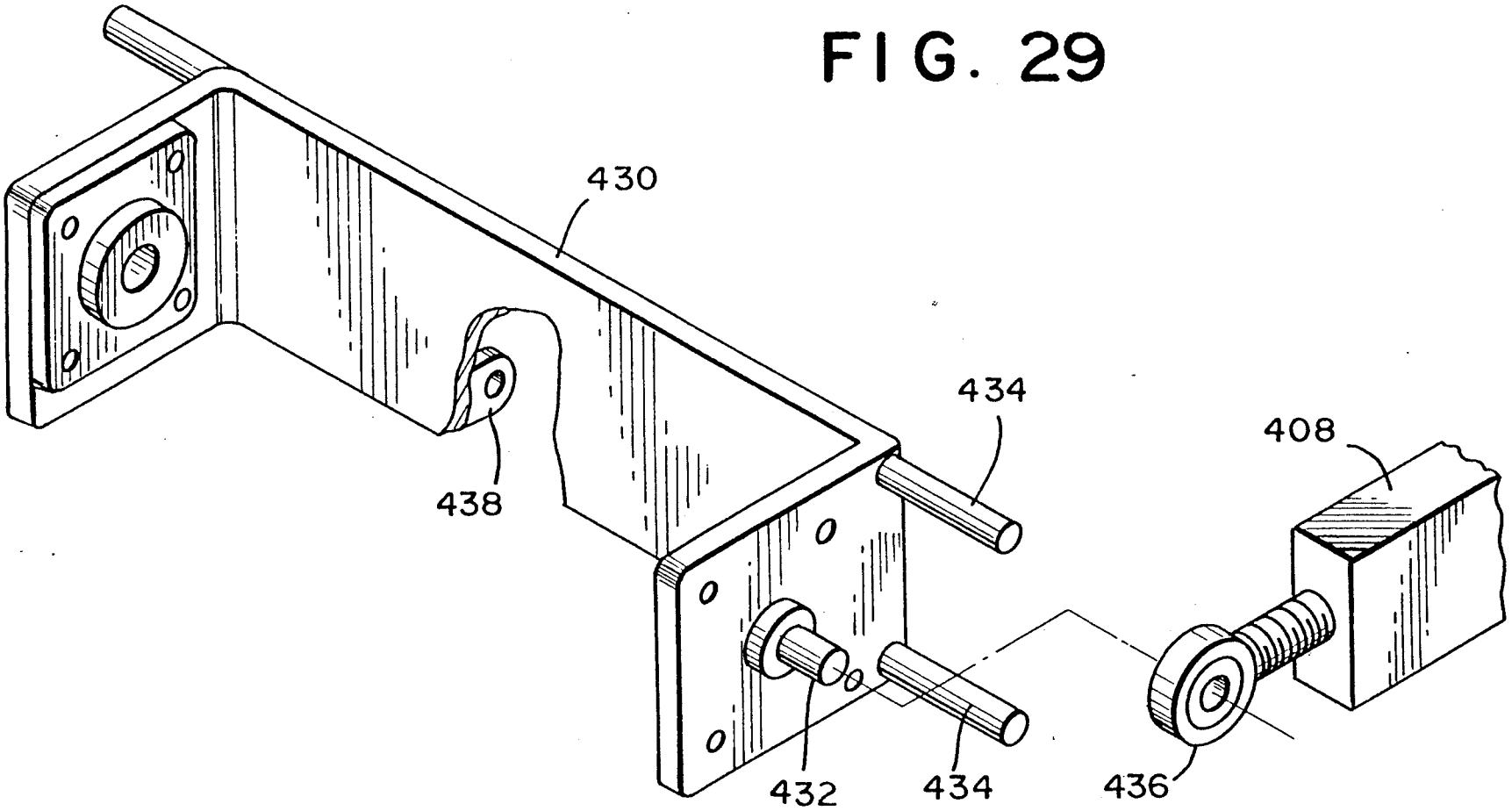
FIG. 29 shows a perspective view of some parts of the FIG. 28 structure.
Figure 30:
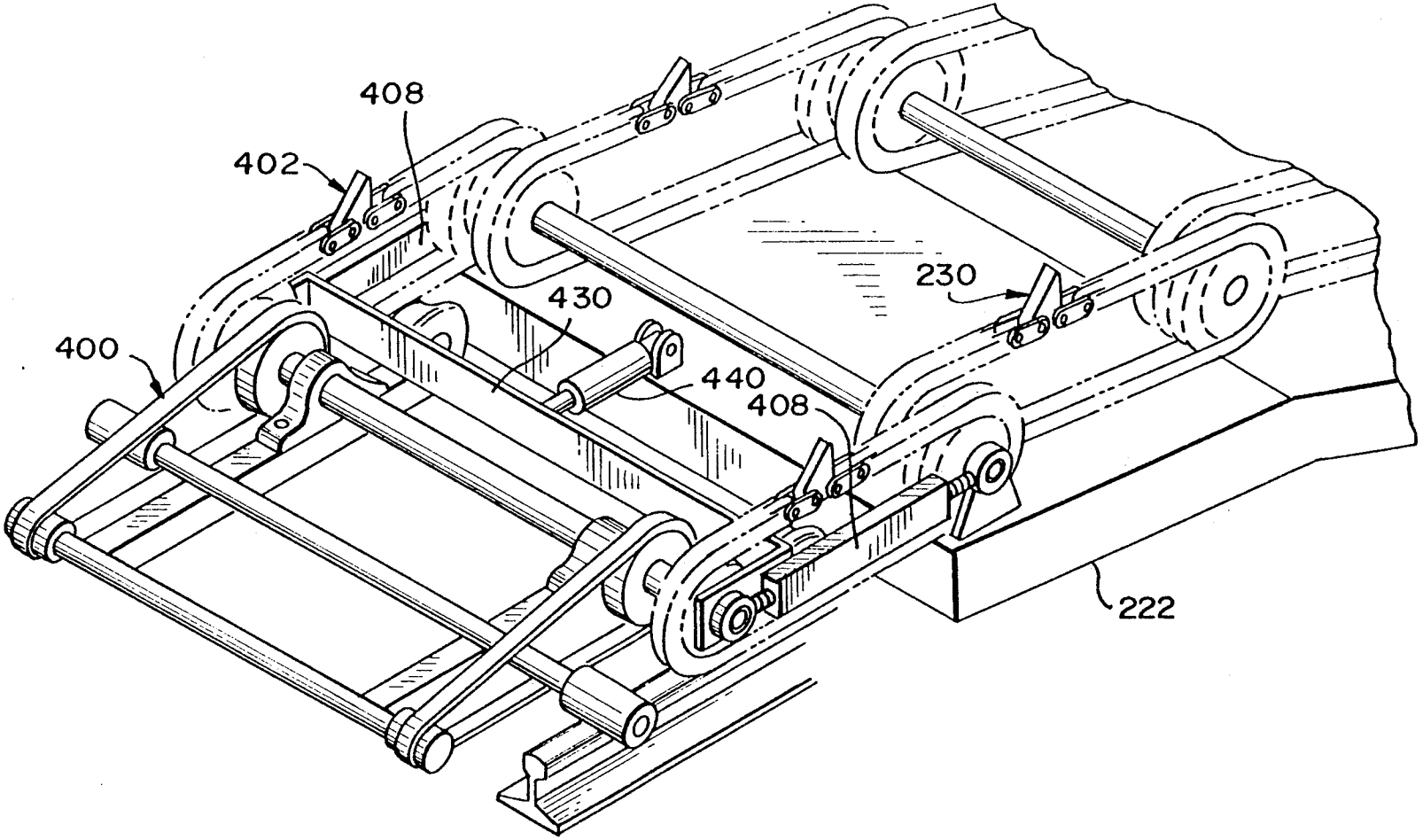
FIG. 30 shows a perspective view of the mechanisms of FIG. 27.

As shown by the broken away part of the bracket 430, a mount flange 438 is disposed thereon (FIG. 29 only). As shown in FIG. 30, a hydraulic cylinder 440 has one end mounted on the main frame. The opposite end, which is not visible, would be secured to the mounting plate or flange 438 of FIG. 29 and could be used for raising or lowering the conveyor 402. Advantageously, the cylinder 440 would include spherical bearings (not separately labeled or shown) at the ends thereof such that the cylinder 440 will not prevent the conveyor 402 from tracking curves in the rails.

Figure 31:
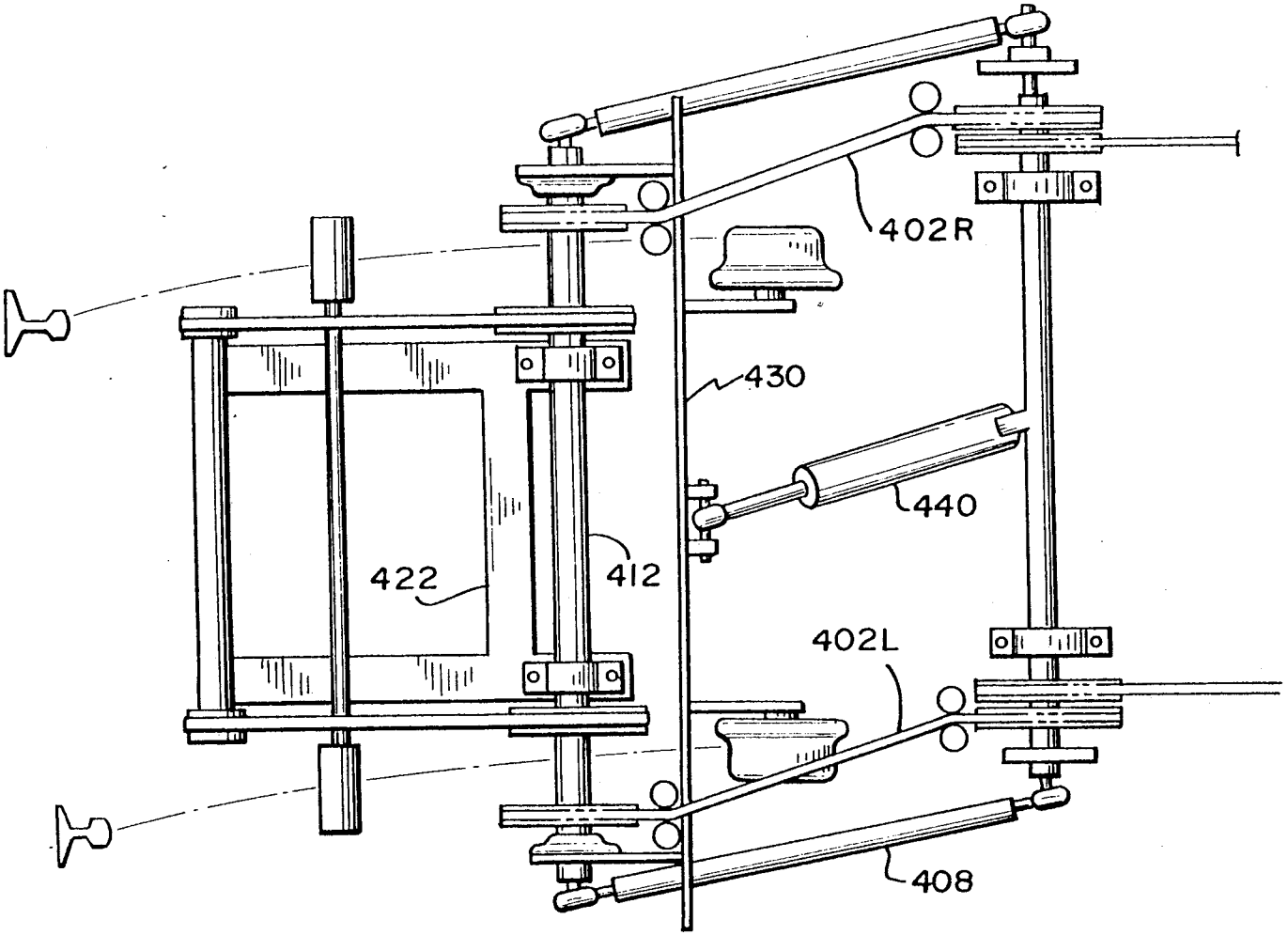
FIG. 31 is a simplified top view of the mechanisms of FIG. 28.

With reference now to FIG. 31, an exaggerated view shows how the flex chain 402R and 402L may flex in order to accommodate curves in the rails associated with the track.

Although not shown the vehicle 16F could include a known rotary sweeper mechanism for ballast sweeping in advance of the tie insertion mechanism.

Although various specific details have been discussed herein, it is to be understood that these are for illustrative purposes only. Various modifications and adaptations will be readily apparent to those of skill in the art. Accordingly, the scope of the present invention should be determined by reference to the claims appended hereto.

What is claimed is:

1. A tie replacement vehicle comprising:

(a) a main frame having a pair of front wheels and a pair of rear wheels;

(b) a first lifting conveyor having a lower end disposable at rail level corresponding to a pair of rails upon which said wheels are supported and an upper end at said main frame, said first lifting conveyor mounted at a first end of said main frame and operable to lift ties from a pair of rails to said main frame;

(c) a first lowering conveyor having a lower end disposable at rail level and an upper end at said main frame, said first lowering conveyor mounted at a second end of said vehicle opposite said first end and operable to lower ties from said main frame to placement on top of the pair of rails;

(d) movement means to selectively move ties over said vehicle from said upper end of said first lifting conveyor to said upper end of said first lowering conveyor; and (e) a tie inserter supported by a said main frame and including a first tie clamp operable to clamp ties disposed on said vehicle at a location between said upper end of said first lifting conveyor and said upper end of said first lowering conveyor, said tie inserter being operable to insert a new tie under the pair of rails while the new tie is clamped by said first tie clamp.

2. The tie replacement vehicle of claim 1 wherein said tie inserter is operable to remove old ties from a road bed.

3. The tie replacement vehicle of claim 1 wherein said movement means includes a first top conveyor for receiving ties from said first lifting conveyor; and further comprising means to move ties down from said first top conveyor to a position whereat said first tie clamp may clamp a tie.

4. The tie replacement vehicle of claim 3 further comprising at least one stop operable to stop ties at a portion of said first top conveyor while said first top conveyor continues to move such that ties backup at said portion.

5. The tie replacement vehicle of claim 4 further comprising a transfer structure and a second top conveyor for receiving ties from said first top conveyor by way of said transfer structure, said second top conveyor operable to convey ties to said first lowering conveyor.

6. The tie replacement vehicle of claim 5 wherein said first top conveyor receives ties from said first lifting conveyor by way of a second lifting conveyor and said second top conveyor conveys ties to said first lowering conveyor by way of a second lowering conveyor.

7. The tie replacement vehicle of claim 5 wherein said tie inserter includes a boom extendable in a boom direction transverse to a lengthwise direction of said vehicle and a tie inserter head having said first tie clamp attached at a first end of an arm mounted to an end of said boom, said arm rotatable about a substantially horizontal axis to lower a tie from said vehicle to a road bed, said axis extending substantially parallel to said boom direction, and said tie inserter is operable to insert ties in the road bed by retraction of said boom.

8. The tie replacement vehicle of claim 3 wherein said tie inserter includes a boom extendable in a boom direction transverse to a lengthwise direction of said vehicle and a tie inserter head having said first tie clamp attached at a first end of an arm mounted to an end of said boom, said arm rotatable about a substantially horizontal axis to lower a tie from said vehicle to a road bed, said axis extending substantially parallel to said boom direction, and said tie inserter is operable to insert ties in the road bed by retraction of said boom.

9. The tie replacement vehicle of claim 8 wherein said arm has a second tie clamp at a second end thereof such that said second tie clamp is operable to clamp an old tie disposed in a road bed when said first tie clamp is clamping a replacement tie, and wherein said extension of said tie inserter is operable upon boom to remove the old tie from the road bed and to displace the replacement tie to outside of rails on the road bed.

10. A tie replacement vehicle comprising:

(a) a main frame having a pair of front wheels and a pair of rear wheels;

(b) support means on said main frame for supporting ties on said vehicle; and (c) a tie inserter supported by said main frame and including a boom extendable in a boom direction transverse to a lengthwise direction of said vehicle and a tie inserter head having a first tie clamp attached at a first end of an arm mounted to an end of said boom, said first tie clamp operable to clamp a tie disposed on said support means, said arm rotatable about a substantially horizontal axis to lower a tie from said vehicle to a road bed, said axis extending substantially parallel to said boom direction, and said tie inserter is operable to insert ties in the road bed by retraction of said boom.

11. The tie replacement vehicle of claim 10 wherein said arm has a second tie clamp at a second end thereof such that said second tie clamp is operable to clamp an old tie disposed in a road bed when said first tie clamp is clamping a replacement tie, and wherein said tie inserter is operable upon extension of said boom to remove the old tie from the road bed and to displace the replacement tie to outside of rails on the road bed.

12. The tie replacement vehicle of claim 11 wherein said first tie clamp maintains a replacement tie substantially horizontal upon rotation of said arm about said axis.

13. The tie replacement vehicle of claim 11 wherein said boom is mounted between said pair of front wheels and said pair of rear wheels.

14. The tie replacement vehicle of claim 11 further comprising:

a first lifting conveyor having a lower end disposable at rail level corresponding to a pair of rails upon which said wheels are supported and an upper end at said main frame, said first lifting conveyor mounted at a first end of said main frame and operable to lift ties from a pair of rails to said main frame; a first lowering conveyor having a lower end disposable at rail level and an upper end at said main frame, said first lowering conveyor mounted at a second end of said vehicle opposite said first end and operable to lower ties from said main frame to placement on top of the pair of rails; and movement means to selectively move ties over said vehicle from said upper end of said first lifting conveyor to said upper end of said first lowering conveyor; and wherein said support means is intermediate said upper end of said first lifting conveyor and said upper end of said first lowering conveyor.

15. The tie replacement vehicle of claim 14 wherein said movement means includes a first top conveyor for receiving ties from said first lifting conveyor; and further comprising means to move ties down from said first top conveyor to a position whereat said first tie clamp may clamp a tie.

16. The tie replacement vehicle of claim 11 further comprising two pairs of electromagnets movably mounted to said main frame and operable to hold tie plates against corresponding rails during removal of a tie from the road bed and insertion of a tie into the road bed.

17. A tie replacement vehicle comprising:

(a) a main frame having a pair of front wheels and a pair of rear wheels;

(b) support means on said main frame for supporting ties on said vehicle;

(c) a tie inserter supported by said main frame and including a boom extendable in a boom direction transverse to a lengthwise direction of said vehicle and a tie inserter head having a first tie clamp attached at a first end of an arm mounted to an end of said boom, and said tie inserter operable to remove ties from a road bed and to lower ties from said vehicle and insert ties in the road bed by retraction of said boom; and (d) two pairs of electromagnets movably mounted to said main frame and operable to hold tie plates against corresponding rails during removal of a tie from the road bed and insertion of a tie into the road bed wherein said arm is rotatable about a substantially horizontal axis which extends generally along said boom direction to lower a tie from said vehicle to a road bed.

18. The tie replacement vehicle of claim 17 wherein said arm has a second tie clamp at a second end thereof such that said second tie clamp is operable to clamp an old tie disposed in a road bed when said first tie clamp is clamping a replacement tie, and wherein said tie inserter is operable upon extension of said boom to remove the old tie from the road bed and to displace the replacement tie to outside of rails on the road bed.

19. The tie replacement vehicle of claim 18 further comprising:

a first lifting conveyor having a lower end disposable at rail level corresponding to a pair of rails upon which said wheels are supported and an upper end at said main frame, said first lifting conveyor mounted at a first end of said main frame and operable to lift ties from a pair of rails to said main frame; a first lowering conveyor having a lower end disposable at rail level and an upper end at said main frame, said first lowering conveyor mounted at a second end of said vehicle opposite said first end and operable to lower ties from said main frame to placement on top of the pair of rails; and movement means to selectively move ties over said vehicle from said upper end of said first lifting conveyor to said upper end of said first lowering conveyor.

* * * * *